US009168756B2

(12) United States Patent
Harada

(10) Patent No.: US 9,168,756 B2
(45) Date of Patent: Oct. 27, 2015

(54) WASTE LIQUID CONTAINER AND WASTE LIQUID DISCHARGING DEVICE

(75) Inventor: Shuhei Harada, Chino (JP)

(73) Assignee: Seiko Epson Corporation, Tokyo (JP)

( * ) Notice: Subject to any disclaimer, the term of this patent is extended or adjusted under 35 U.S.C. 154(b) by 365 days.

(21) Appl. No.: 12/394,172

(22) Filed: Feb. 27, 2009

(65) Prior Publication Data

US 2009/0218270 A1 Sep. 3, 2009

(30) Foreign Application Priority Data

| | | |
|---|---|---|
| Feb. 29, 2008 | (JP) | 2008-049541 |
| Feb. 29, 2008 | (JP) | 2008-049542 |
| Feb. 29, 2008 | (JP) | 2008-049543 |
| Apr. 28, 2008 | (JP) | 2008-117552 |
| Apr. 28, 2008 | (JP) | 2008-117553 |

(51) Int. Cl.

| | |
|---|---|
| ***B41J 2/165*** | (2006.01) |
| ***B41J 2/185*** | (2006.01) |
| ***B41J 2/17*** | (2006.01) |
| ***B41J 2/175*** | (2006.01) |

(52) U.S. Cl.

CPC *B41J 2/185* (2013.01); *B41J 2/175* (2013.01); *B41J 2/1721* (2013.01); *B41J 2002/1728* (2013.01)

(58) Field of Classification Search

None

See application file for complete search history.

(56) References Cited

U.S. PATENT DOCUMENTS

| | | | | |
|---|---|---|---|---|
| 4,901,094 | A | 2/1990 | Iwagami | |
| 5,023,629 | A | 6/1991 | Kiyohara | |
| 5,221,935 | A | 6/1993 | Uzita | |
| 5,506,611 | A | 4/1996 | Ujita et al. | |
| 5,912,687 | A * | 6/1999 | Cowger et al. | 347/85 |
| RE36,279 | E | 8/1999 | Ujita | |
| 6,042,216 | A | 3/2000 | Garcia et al. | |
| 6,170,937 | B1 | 1/2001 | Childers et al. | |
| 6,203,138 | B1 | 3/2001 | Hirabayashi | |

(Continued)

FOREIGN PATENT DOCUMENTS

| | | |
|---|---|---|
| CN | 1272432 | 11/2000 |
| EP | 0412459 | 2/1991 |

(Continued)

OTHER PUBLICATIONS

European Search Report mailed on Jan. 21, 2011, for European Patent Application No. 09714143.6.

(Continued)

*Primary Examiner* — Alejandro Valencia

(74) *Attorney, Agent, or Firm* — Workman Nydegger

(57) ABSTRACT

A waste liquid container that can be installed to a waste liquid discharging device main body. The waste liquid container includes an insertion hole into which a waste liquid discharging nozzle, which is included in the waste liquid discharging device main body, having a large diameter portion and a small diameter portion located on a front end side relative to the large diameter portion is inserted. When the waste liquid container is installed to the waste liquid discharging device main body, the insertion hole guides the small diameter portion by being brought into contact with an outer circumferential face of the small diameter portion in an inner face of the insertion hole and determines a position of the waste liquid container in a diameter direction of the large diameter portion with respect to the waste liquid discharging device main body by being fitted with the large diameter portion.

15 Claims, 23 Drawing Sheets

(56) References Cited

U.S. PATENT DOCUMENTS

| | | | | |
|---|---|---|---|---|
| 6,220,314 | B1 | 4/2001 | Sato | |
| 6,227,642 | B1 | 5/2001 | Hanabusa | |
| 6,281,911 | B1 | 8/2001 | Nakazawa et al. | |
| 6,832,860 | B2 | 12/2004 | Yoon | |
| 6,999,702 | B2 | 2/2006 | Fordahl | |
| 7,226,154 | B2 | 6/2007 | Seino | |
| 7,490,929 | B2 | 2/2009 | Seino | |
| 7,571,981 | B2 | 8/2009 | Yamada | |
| 7,661,790 | B2 | 2/2010 | Harada et al. | |
| 7,681,982 | B2 | 3/2010 | Suzuki | |
| 7,950,789 | B2 | 5/2011 | Matsumoto | |
| 2005/0018009 | A1 | 1/2005 | Otsubo | |
| 2005/0041061 | A1 | 2/2005 | Ishizawa et al. | |
| 2005/0078145 | A1 | 4/2005 | Inoue et al. | |
| 2005/0195241 | A1 | 9/2005 | Kawai et al. | |
| 2005/0200650 | A1 | 9/2005 | Inokuchi | |
| 2006/0017770 | A1* | 1/2006 | Harada et al. | 347/36 |
| 2007/0008372 | A1 | 1/2007 | Katada | |
| 2007/0030304 | A1 | 2/2007 | Yamada | |
| 2007/0035578 | A1* | 2/2007 | Suzuki | 347/36 |
| 2007/0058011 | A1 | 3/2007 | Wencel | |
| 2008/0049058 | A1 | 2/2008 | Yakura et al. | |
| 2009/0219337 | A1 | 9/2009 | Harada et al. | |
| 2009/0219338 | A1 | 9/2009 | Harada et al. | |
| 2009/0219339 | A1 | 9/2009 | Harada et al. | |

FOREIGN PATENT DOCUMENTS

| | | | |
|---|---|---|---|
| EP | 0928694 | | 7/1999 |
| EP | 1013446 | | 6/2000 |
| EP | 1431037 | | 6/2004 |
| JP | 01-174460 | | 7/1989 |
| JP | 02-182643 | A | 7/1990 |
| JP | 05-069557 | | 3/1993 |
| JP | 05-162334 | | 6/1993 |
| JP | 06-064185 | | 3/1994 |
| JP | 06-198907 | | 7/1994 |
| JP | 09-109411 | | 4/1997 |
| JP | 11-078053 | A | 3/1999 |
| JP | 11-129488 | | 5/1999 |
| JP | 2000-085145 | | 3/2000 |
| JP | 2007-127453 | | 5/2000 |
| JP | 2000-238292 | | 9/2000 |
| JP | 2001-310486 | | 11/2001 |
| JP | 2001-353882 | | 12/2001 |
| JP | 2002-029065 | | 1/2002 |
| JP | 2002-301831 | | 10/2002 |
| JP | 2004-025808 | | 1/2004 |
| JP | 2004-345249 | | 12/2004 |
| JP | 2005-061245 | | 3/2005 |
| JP | 2006-029161 | | 2/2006 |
| JP | 2006-035697 | | 2/2006 |
| JP | 2006-044243 | | 2/2006 |
| JP | 2006-123563 | | 5/2006 |
| JP | 2006-142630 | | 6/2006 |
| JP | 2006-218846 | | 8/2006 |
| JP | 2006-256140 | A | 9/2006 |
| JP | 2007-038590 | | 2/2007 |
| JP | 2007-040215 | | 2/2007 |
| JP | 2007-050548 | | 3/2007 |
| JP | 2007-130998 | | 5/2007 |
| JP | 2007-223227 | | 9/2007 |
| JP | 2008-036984 | | 2/2008 |

OTHER PUBLICATIONS

U.S. Appl. No. 12/394,290, Feb. 25, 2011, Office Action.
U.S. Appl. No. 12/394,290, Sep. 8, 2011, Office Action.
U.S. Appl. No. 12/394,263, Jun. 14, 2011, Office Action.
U.S. Appl. No. 12/394,263, Nov. 22, 2011, Office Action.
U.S. Appl. No. 12/394,233, Jun. 14, 2011, Office Action.
U.S. Appl. No. 12/394,233, Nov. 25, 2011, Office Action.

* cited by examiner

WASTE LIQUID CONTAINER AND WASTE LIQUID DISCHARGING DEVICE

CROSS REFERENCES TO RELATED APPLICATIONS

The present invention contains subject matter related to Japanese Patent Application No. 2008-049541, 2008-049542, 2008-049543, 2008-117552, and 2008-117553 filed in the Japanese Patent Office on Feb. 29, 2008, Feb. 29, 2008, Feb. 29, 2008, Apr. 28, 2008, and Apr. 28, 2008, the entire contents of which are incorporated herein by reference.

BACKGROUND

1. Technical Field

The present invention relates to a waste liquid container that is used for housing waste liquid generated inside a waste liquid discharging device and can be installed to a waste liquid discharging device main body and a waste liquid discharging device having the waste liquid container.

2. Related Art

Generally, as waste liquid discharging devices that discharge waste liquid inside the devices, ink jet printers and the like are widely known. For example, in the ink jet printers, in order to suppress clogging of a nozzle (ink injecting nozzle) due to ink having increased viscosity and discharge air bubbles and dusts that are mixed into ink inside a head, a cleaning operation for forcedly injecting ink inside the head from the ink injecting nozzle so as to be discharged is performed.

In addition, inside the waste liquid discharging devices, a waste liquid discharging device main body that includes a waste liquid discharging nozzle for discharging the waste liquid, an insertion hole into which the waste liquid discharging nozzle is inserted, and a waste liquid container that houses the waste liquid that is discharged in the waste liquid discharging device are included. Among waste liquid containers, there are waste liquid containers that can be attached, detached, and replaced with respect to the waste liquid discharging device main body. In the waste liquid discharging devices, when the waste liquid container is installed to the waste liquid discharging device main body, the waste liquid discharging nozzle is inserted into the insertion hole. Then, the position of the waste liquid container with respect to the waste liquid discharging device main body in the diameter direction of the waste liquid discharging nozzle is determined by fitting the insertion hole with the waste liquid discharging nozzle, finally.

A related art has been disclosed in JP-A-2007-130998.

It is preferable that installation of the waste liquid container to the waste liquid discharging device main body can be performed in a simplified manner. However, for example, when the posture of the waste liquid container is adjusted such that the waste liquid discharging nozzle is inserted into the insertion hole and the waste liquid container is to be installed to the waste liquid discharging device main body with the posture of the waste liquid container maintained, the waste liquid container may not reach a position in which the insertion hole is fitted with the waste liquid discharging nozzle due to collapse of the posture in the middle of the installation process or the like. In other words, when the waste liquid container is to be installed to the waste liquid discharging device main body with the posture of the waste liquid container maintained, it is difficult to install the waste liquid container.

SUMMARY

An advantage of some aspects of the invention is that it provides a waste liquid container that can be installed to the waste liquid discharging device main body in an easy manner and a waste liquid discharging device having the waste liquid container.

The invention can be implemented in the following applied examples or forms.

According to a first aspect of the invention, there is provided a waste liquid container that can be installed to a waste liquid discharging device main body. The waste liquid container includes an insertion hole into which a waste liquid discharging nozzle, which is included in the waste liquid discharging device main body, having a large diameter portion and a small diameter portion located on a front end side relative to the large diameter portion is inserted. When the waste liquid container is installed to the waste liquid discharging device main body, the insertion hole guides the small diameter portion by being brought into contact with an outer circumferential face of the small diameter portion in an inner face of the insertion hole and determines a position of the waste liquid container in a diameter direction of the large diameter portion with respect to the waste liquid discharging device main body by being fitted with the large diameter portion.

According to a second aspect of the invention, there is provided a waste liquid discharging device including: a waste liquid discharging device main body that includes a waste liquid discharging nozzle for discharging waste liquid; and a waste liquid container that includes an insertion hole into which the waste liquid discharging nozzle is inserted and can be installed to the waste discharging device main body. The waste liquid discharging nozzle includes a large diameter portion and a small diameter portion that is located on a front end side relative to the large diameter portion. In addition, when the waste liquid container is installed to the waste liquid discharging device main body, the waste liquid container guides the small diameter portion by being brought into contact with an outer circumferential face of the small diameter portion during a period in which the small diameter portion passes the inside of the insertion hole, and the insertion hole determines a position of the waste liquid container in a diameter direction of the large diameter portion with respect to the waste liquid discharging device main body by being fitted with the large diameter portion.

Other aspects of the invention will become apparent by descriptions below and the accompanying drawings.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
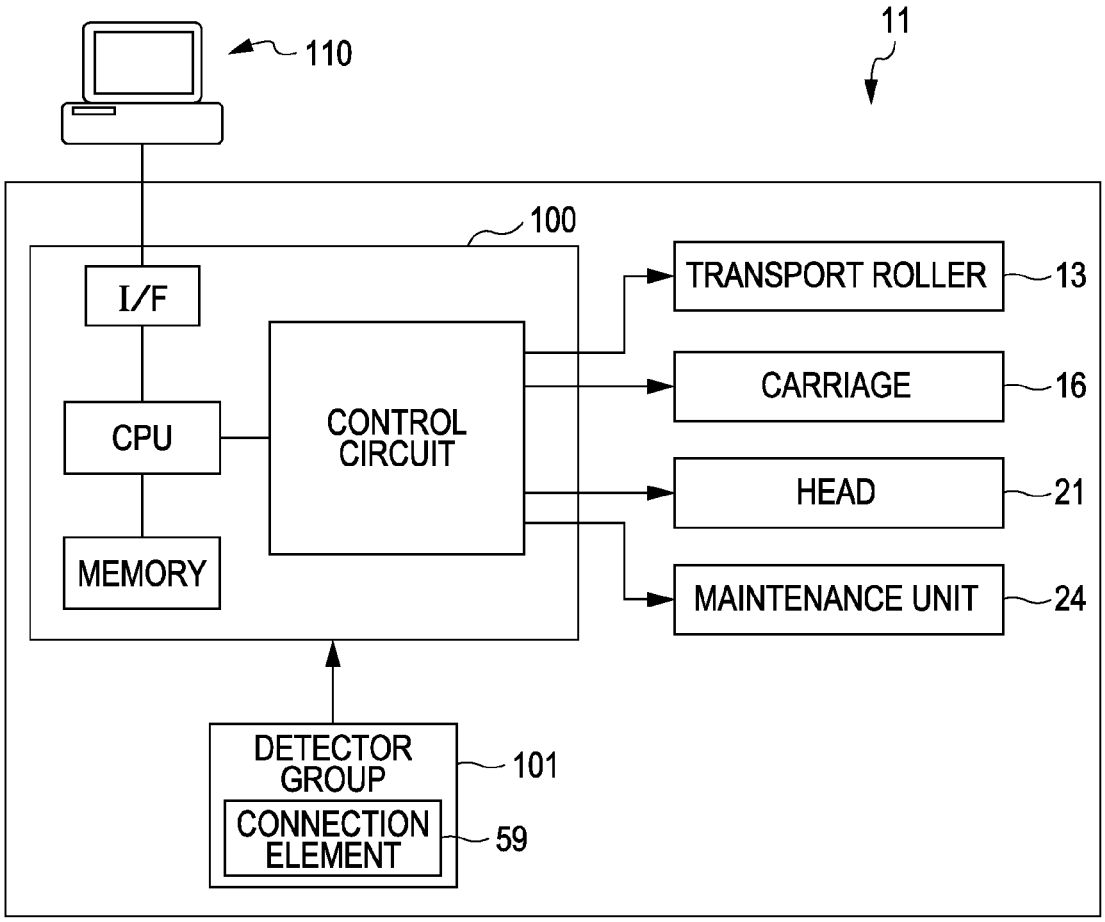
FIG. 1 is a block diagram showing the configuration of a printer 11 according to an embodiment of the invention.

According to descriptions below and the accompanying drawings, at least the followings are disclosed.

According to a first aspect of the invention, there is provided a waste liquid container that can be installed to a waste liquid discharging device main body. The waste liquid container includes an insertion hole into which a waste liquid discharging nozzle, which is included in the waste liquid discharging device main body, having a large diameter portion and a small diameter portion located on a front end side relative to the large diameter portion is inserted. When the waste liquid container is installed to the waste liquid discharging device main body, the insertion hole guides the small diameter portion by being brought into contact with an outer circumferential face of the small diameter portion in an inner face of the insertion hole and determines a position of the waste liquid container in a diameter direction of the large diameter portion with respect to the waste liquid discharging device main body by being fitted with the large diameter portion.

In order to install the waste liquid container to the waste liquid discharging device main body, as described above, the insertion hole is fitted with the waste liquid discharging nozzle so as to determine the position of the waste liquid container in the diameter direction of the waste liquid discharging nozzle with respect to the waste liquid discharging device main body. When the waste liquid container is installed to the waste liquid discharging device main body, the insertion hole provided in the waste liquid container according to an embodiment of the invention guides the small diameter portion by being fitted with the large diameter portion of the waste liquid discharging nozzle and being brought into contact with the outer circumferential face of the small diameter portion located on the front end side of the waste liquid discharging nozzle relative to the large size diameter. As described above, since the small diameter portion is guided by the insertion hole, the waste liquid container can be moved so as to be fitted with the large diameter portion in an easy manner. Accordingly, the waste liquid container can be easily installed to the waste liquid discharging device main body with the posture of the waste liquid container maintained.

In the above-described waste liquid container, it may be configured that an installation direction for installing the waste liquid container to the waste liquid discharging device main body is a horizontal direction, and the waste liquid container is tilted such that a front end part of the waste liquid container in the installation direction is located on a lower side relative to a rear end part of the waste liquid container when the waste liquid container is installed to the waste liquid discharging device main body. In the case, the insertion hole guides the small diameter portion to a position in which the small diameter portion is located at a time when the insertion hole is fitted with the large diameter portion by bringing the inner face of the insertion hole into contact with the outer circumferential face of the small diameter portion. When the waste liquid container is installed to the waste liquid discharging device main body, in a case where the waste liquid container is tilted such that the front end part in the installation direction of the waste liquid container is located on the lower side relative to the rear end part, generally, it becomes more difficult to position the small diameter portion (that is, to install the waste liquid container to the waste liquid discharging device main body) in a position in which the small diameter portion is located at a time when the insertion hole is fitted with the large diameter portion. However, in such a case, since the insertion hole guides the small diameter portion to the position in which the small diameter portion is located at a time when the insertion hole is fitted with the large diameter portion, the waste liquid container can be installed in an easy manner.

In addition, in the above-described waste liquid container, the insertion hole may be configured to be brought into contact with an upper part of the outer circumferential face of the small diameter portion in an upper part of the inner face of the insertion hole when the waste liquid container is installed to the waste liquid discharging device main body. In such a case, the direction of contact between the inner face of the insertion hole and the outer circumferential face of the small diameter portion follows the direction of gravity, and accordingly, the insertion hole can be brought into contact with the outer circumferential face of the small diameter portion in an easy manner. Accordingly, the waste liquid container can be installed in an easier manner.

In addition, in the above-described waste liquid container, the insertion hole may be configured to be brought into contact with the outer circumferential face of the small diameter portion that is biased in the inner face of the insertion hole by a biasing member, which is included in the waste liquid discharging device main body, so as to face the outer circumferential face of the small diameter portion toward the inner face of the insertion hole when the waste liquid container is installed to the waste liquid discharging device main body. In such a case, the insertion hole can be brought into contact with the outer circumferential face of the small diameter portion in the inner face thereof assuredly by biasing of the biasing member. In other words, the function of the insertion hole for guiding the small diameter portion can be exhibited assuredly. As a result, the waste liquid container can be installed in an easier manner.

In addition, in the above-described waste liquid container, the insertion hole may be configured to continuously guide the small diameter portion by being continuously brought into contact with the outer circumferential face of the small diameter portion in the inner face of the insertion hole while the small diameter portion passes the inside of the insertion hole. In such a case, the small diameter portion is guided by the insertion hole all the time while the small diameter portion passes the inside of the insertion hole. Accordingly, the waste liquid container can be moved such that the small diameter portion is located in the position in which the small diameter portion is located at a time when the insertion hole is fitted with the large diameter portion, in an easier manner. In other words, the waste liquid container can be installed in an easier manner.

According to a second aspect of the invention, there is provided a waste liquid discharging device including: a waste liquid discharging device main body that includes a waste liquid discharging nozzle for discharging waste liquid; and a waste liquid container that includes an insertion hole into which the waste liquid discharging nozzle is inserted and can be installed to the waste discharging device main body. The waste liquid discharging nozzle includes a large diameter portion and a small diameter portion that is located on a front end side relative to the large diameter portion. In addition, when the waste liquid container is installed to the waste liquid discharging device main body, the waste liquid container guides the small diameter portion by being brought into contact with an outer circumferential face of the small diameter portion during a period in which the small diameter portion passes the inside of the insertion hole, and the insertion hole determines a position of the waste liquid container in a diameter direction of the large diameter portion with respect to the waste liquid discharging device main body by being fitted with the large diameter portion.

In order to install the waste liquid container to the waste liquid discharging device main body, as described above, the insertion hole is fitted with the waste liquid discharging nozzle so as to determine the position of the waste liquid container in the diameter direction of the waste liquid discharging nozzle with respect to the waste liquid discharging device main body. In a waste liquid discharging device according to an embodiment of the invention, when the waste liquid container is installed to the waste liquid discharging device main body, the insertion hole is fitted with the large diameter portion of the waste liquid discharging nozzle. In addition, in order for the small diameter portion located on the front end side of the waste liquid discharging nozzle relative to the large diameter portion to pass the inside of the insertion hole (that is, before the insertion hole is fitted with the large diameter portion), the waste liquid container guides the small diameter portion by being brought into contact with the outer circumferential face of the small diameter portion. As a result, since the small diameter portion is guided by the waste liquid container as described above, the waste liquid container can be easily moved such that the insertion hole is be fitted with the large diameter portion.

As a result, the waste liquid discharging device capable of easily installing the waste liquid container to the waste liquid discharging device main body with the posture of the waste liquid container being maintained is implemented.

In the above-described waste liquid discharging device, it may be configured that an installation direction for installing the waste liquid container to the waste liquid discharging device main body is a horizontal direction. In this case, when the waste liquid container is installed to the waste liquid discharging device main body, the waste liquid container guides the small diameter portion to a position in which the small diameter portion is located at a time when the insertion hole is fitted with the large diameter portion by being tilted such that a front end part of the waste liquid container in the installation direction is located on a lower side relative to a rear end part of the waste liquid container and being brought into contact with the outer circumferential face of the small diameter portion during a period in which the small diameter portion passes the inside of the insertion hole. When the waste liquid container is installed to the waste liquid discharging device main body, in a case where the waste liquid container is tilted such that the front end part in the installation direction of the waste liquid container is located on the lower side relative to the rear end part, generally, it becomes more difficult to position the small diameter portion (that is, to install the waste liquid container to the waste liquid discharging device main body) in a position in which the small diameter portion is located at a time when the insertion hole is fitted with the large diameter portion. However, in such a case, since the waste liquid container guides the small diameter portion to the position in which the small diameter portion is located at a time when the insertion hole is fitted with the large diameter portion, the waste liquid container can be installed in an easy manner.

In addition, in the above-described waste liquid discharging device, when the waste liquid container is installed to the waste liquid discharging device main body, the waste liquid container may be configured to be brought into contact with the outer circumferential face of the small diameter portion in the inner face of the insertion hole while the small diameter portion passes the inside of the insertion hole. In such a case, a configuration for bringing the waste liquid container into contact with the outer circumferential face of the small diameter portion during a period in which the small diameter portion passes the inside of the insertion hole becomes simple.

In addition, the above-described waste liquid discharging device, when the waste liquid container is installed to the waste liquid discharging device main body, the waste liquid container may be configured to be brought into contact with an upper part of the outer circumferential face of the small diameter portion in an upper part of the inner face of the insertion hole while the small diameter portion passes the inside of the insertion hole. In such a case, the direction of contact between the inner face of the insertion hole and the outer circumferential face of the small diameter portion follows the direction of gravity, and accordingly, the waste liquid container can be brought into contact with the outer circumferential face of the small diameter portion on the inner face of the insertion hole in an easy manner. Accordingly, the waste liquid container can be installed in an easier manner.

In addition, in the above-described waste liquid discharging device, it may be configured that the waste liquid discharging device main body includes a biasing member that is used for biasing the small diameter portion such that the outer circumferential face of the small diameter portion is faced with the inner face of the insertion hole during a period in which the small diameter portion passes the inside of the insertion hole. In this case, when the waste liquid container is installed to the waste liquid discharging device main body, the waste liquid container is brought into contact with the outer circumferential face of the small diameter portion, which is biased by the basing member, in the inner face of the insertion hole while the small diameter portion passes the inside of the insertion hole. In such a case, the waste liquid container can be brought into contact with the outer circumferential face of the small diameter portion on the inner face of the insertion hole assuredly by biasing of the biasing member. In other words, the function of the waste liquid container for guiding the small diameter portion can be exhibited assuredly. As a result, the waste liquid container can be installed in an easier manner.

In addition, in the above-described waste liquid discharging device, when the waste liquid container is installed to the waste liquid discharging device main body, the waste liquid container may be configured to continuously guide the small diameter portion by continuously being brought into contact with the outer circumferential face of the small diameter portion while the small diameter portion passes the inside of the insertion hole. In such a case, the small diameter portion is guided by the waste liquid container all the time while the small diameter portion passes the inside of the insertion hole. Accordingly, the waste liquid container can be moved such that the small diameter portion is located in the position in which the small diameter portion is located at a time when the insertion hole is fitted with the large diameter portion, in an easier manner. In other words, the waste liquid container can be installed in an easier manner.

Waste Liquid Container and Waste Liquid Discharging Device According to Embodiments of Invention Hereinafter, in describing a waste liquid container according to an embodiment of the invention, an ink jet printer (hereinafter, a printer 11) having the waste liquid container therein as a waste liquid discharging device will be described as an example.

Basic Configuration of Printer 11

Figure 2:
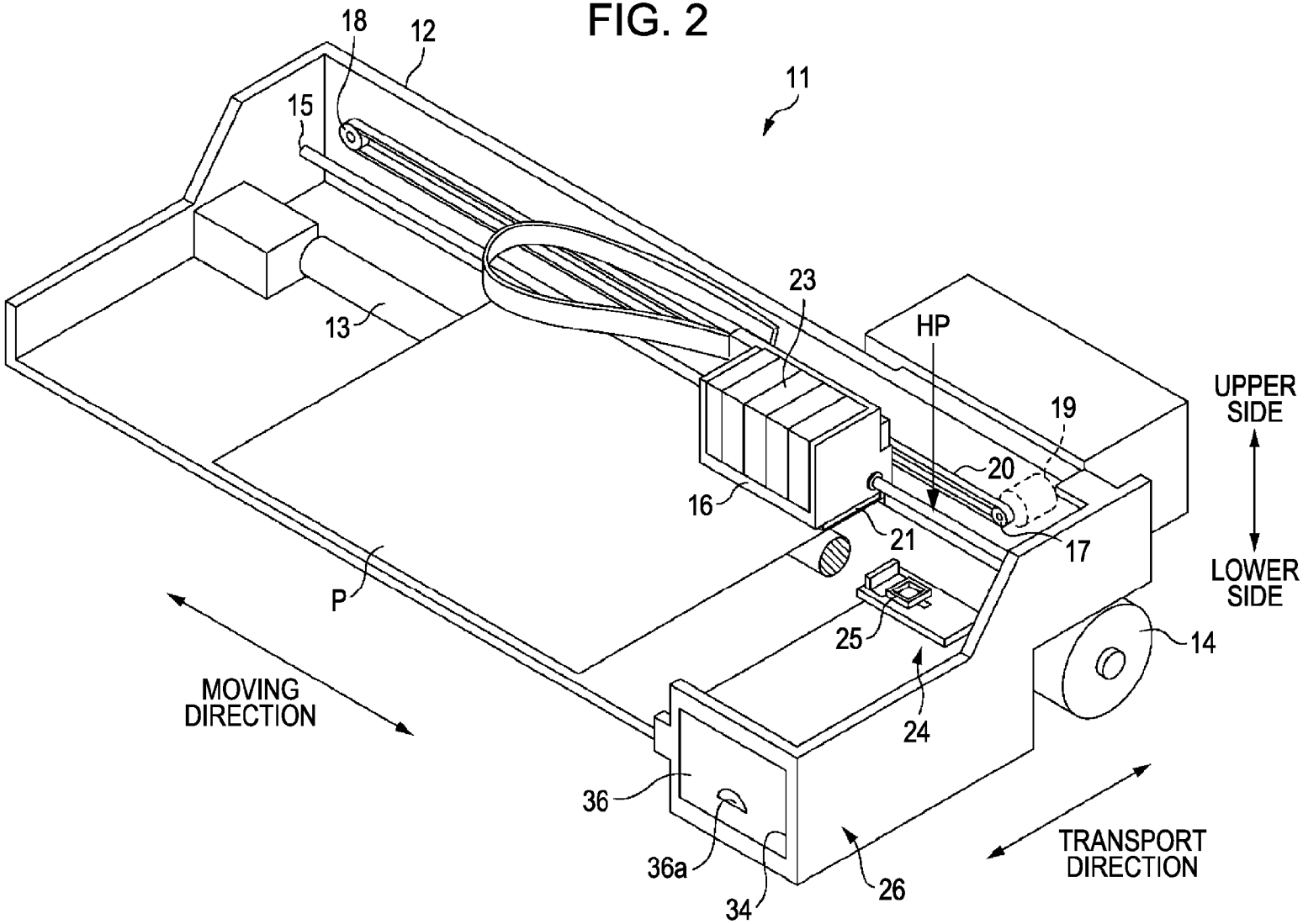
FIG. 2 is a schematic diagram showing the entire configuration of the printer 11.

First, the basic configuration of the printer 11 according to this embodiment will be described with reference to FIGS. 1 and 2. FIG. 1 is a block diagram showing the configuration of the printer 11. FIG. 2 is a schematic diagram showing the entire configuration of the printer 11. In FIG. 2, the upper and lower directions of the printer 11, a transport direction of a recording sheet P, and a moving direction of a carriage 16 are denoted by arrows.

The printer 11 is a liquid injecting apparatus that injects ink as liquid onto a recording sheet P for receiving print data from a host computer 110 and printing an image on the recording sheet P as an example of a recording medium based on the print data. According to this embodiment, the printer 11, as shown in FIGS. 1 and 2, includes a transport roller 13, a carriage 16, a head 21, a maintenance unit 24, and a printer controller 100 as its major constituent elements.

The transport roller 13 is a roller that rotates in correspondence with a moving direction on the inner side of a frame 12 of the printer 11. The transport roller 13 rotates while being brought into frictional contact with the recording sheet P on the outer circumferential face, whereby transporting a recording sheet P in the transport direction. As shown in FIG. 2, a transport motor 14 is disposed as a driving source of the transport roller 13.

The carriage 16 reciprocates along a guide shaft 15 that supports the carriage 16 inside the frame 12, and thereby transports the head 21 mounted on the carriage 16 in the moving direction of the carriage 16. In addition, as shown in FIG. 2, in order to move the carriage 16, a driving pulley 17, a driven pulley 18, a driving motor 19 that drives the driving pulley 17, and a timing belt 20 that extends over the above-described two pulleys are disposed. The timing belt 20 is fixed and supported by the carriage 16. Thus, as the timing belt 20 rotates, the carriage 16 moves in the moving direction.

The head 21 includes a plurality of ink injecting nozzles on the lower face 22 thereof and is used for injecting ink toward a recording sheet P from the ink injecting nozzles. On the lower face 22 of the head 21, the plurality of the ink injecting nozzles is disposed in parallel to one another with a constant pitch in a direction along the transport direction, and whereby nozzle rows are formed. The printer 11 according to this embodiment is a color ink jet printer that injects ink of five colors, and the nozzle rows are formed for each color of ink. In addition, in each ink injecting nozzle, an ink chamber and a piezo element that are not shown in the figure are disposed. By driving the piezo element so as to expand and contract the ink chamber, ink having a drop shape is injected from the ink injecting nozzle.

In addition, a plurality of (in this embodiment, five) ink cartridges 23 for supplying ink to the head 21 is disposed. According to this embodiment, as shown in FIG. 2, each ink cartridge 23 is mounted on the carriage 16 in a detachable state. However, the invention is not limited to a configuration (so-called an on-carriage type) in which the ink cartridges 23 are mounted on the carriage 16. Thus, a configuration (so-called an off-carriage type) in which the ink cartridges 23 are installed outside the carriage 16 may be used.

The maintenance unit 24 is used for performing a cleaning operation for the head 21 as a maintenance operation for injecting ink from the ink injecting nozzles well continuously. The cleaning operation is performed for suppressing clogging of nozzles that occurs due to ink having increased viscosity near openings of the ink injecting nozzles or removing dusts or air bubbles mixed in the ink. The cleaning operation is an operation for forcedly discharging ink by injecting ink from the ink injecting nozzles. By performing the cleaning operation, the ink (hereinafter, referred to as waste ink) is discharged as waste liquid inside the printer 11. The waste ink that is generated by the cleaning operation is an example of the waste liquid.

In order to perform the above-described cleaning operation, the maintenance unit 24 is disposed in a home position HP, which is formed in a non-printing area that the recording sheet P does not reach, located in one end part in the moving direction inside the frame 12. This home position HP is a position in which the head 21 is located at a time when the maintenance unit 24 performs the cleaning operation for the head 21. The configuration of the maintenance unit 24 will be described later in detail.

The printer controller 100 controls the above-described constituent elements (that is, the transport roller 13, the carriage 16, the head 21, and the maintenance unit 24) through a control circuit, based on the print data that is transmitted from the host computer 110. The state of the inside of the printer 11 is monitored by the detector group 101, and the detector group 101 outputs a signal corresponding to the result of detection toward the printer controller 100.

Overview of Configuration of Maintenance Unit 24

Figure 3:
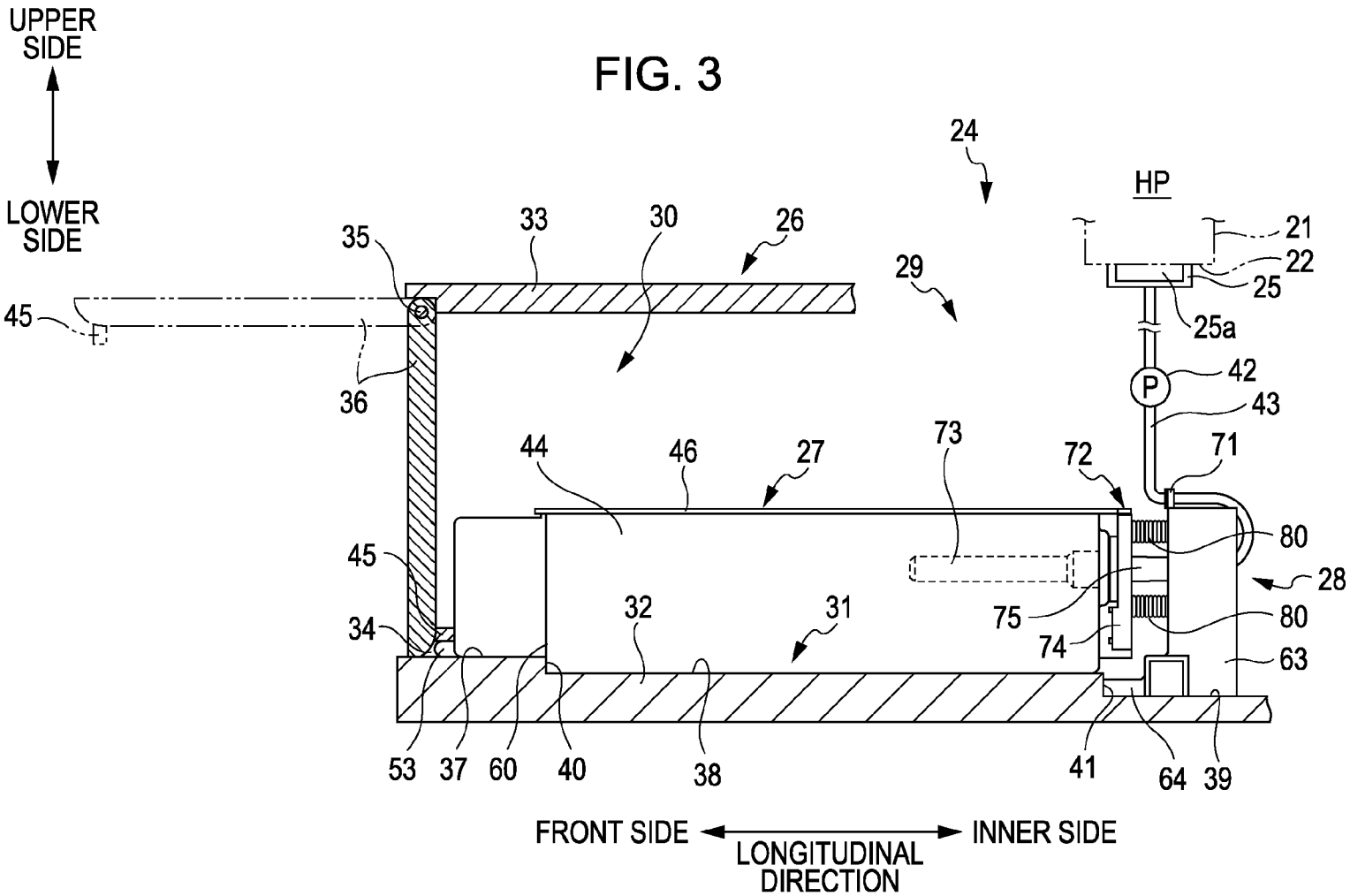
FIG. 3 is a schematic diagram showing the configuration of a maintenance unit 24 according to an embodiment of the invention.

Next, the outline of the configuration of the maintenance unit 24 will be described with reference to FIG. 3. FIG. 3 is a schematic diagram showing the configuration of the maintenance unit 24. In the figure, the upper and lower directions of the printer 11 and the longitudinal direction of a housing unit 26 are denoted by arrows. For understanding the description easily, a waste liquid discharging nozzle 73 that is connected to a waste ink tank 27 is denoted by a broken line in the figure.

The maintenance unit 24, as shown in FIG. 3, includes a cap 25, a suction pump 42, a waste liquid collecting system 29, and the housing unit 26.

The cap 25 seals the lower face 22 by being brought into contact with the lower face 22 of the head 21 for preventing dry of ink inside the ink injection nozzles at a time when the head 21 is located in the home position HP. The cap 25 is elevated to a position for contacting the lower face 22 of the head 21 by an elevation mechanism not shown in the figure at a time when the head 21 is located in the home position HP. On the other hand, the cap 25 is lowered by the elevation mechanism at a time when the head 21 is distanced from the home position HP. In addition, in the upper end face of the cap 25, an opening is formed. Thus, when the cap 25 is brought into contact with the lower face 22 of the head 21, the opening surrounds the nozzle rows. As a result, when the cap 25 is brought into contact with the lower face 22 of the head 21, an enclosed space 25*a* is formed under the nozzle rows as shown in FIG. 3.

In order to forcedly inject ink from the ink injecting nozzles of the head 21, the suction pump 42 performs a suction operation in a state in which the cap 25 is brought into contact with the lower face 22 of the head 21. When the suction pump 42 is operated in the state in which the cap 25 is brought into contact with the lower face 22 of the head 21, negative pressure is generated inside the enclosed space 25*a*. Accordingly, the ink located inside the ink injecting nozzles is forcedly injected from the ink injecting nozzles so as to be discharged into the above-described enclosed space 25*a*. In other words, the enclosed space 25*a* is a space that is used for receiving the waste ink that is forcedly discharged from the ink injecting nozzles.

The waste liquid collecting system 29 is used for collecting the waste ink that is generated by the cleaning operation. The waste liquid collecting system 29, as shown in FIG. 3, includes the waste ink tank 27 as a waste liquid container and a waste liquid discharging nozzle unit 28.

The waste liquid discharging nozzle unit 28 is used for forming a flow path for sending the waste ink from the enclosed space 25*a* toward the waste ink tank 27. Described in more details, the upstream end part of the waste liquid discharging nozzle unit 28 supports a flexible tube 43 that is connected to the cap 25, and the downstream end part (an end part located on a side opposite to the side connected to the cap 25) of the flexible tube 43 is led into the waste ink tank 27. This waste liquid discharging nozzle unit 28 is a resin-molded product having rigidity that is formed by using the waste liquid discharging nozzle 73, which is approximate tube shaped, as a main body. In addition, in the waste liquid discharging nozzle unit 28, a downstream end part of the flexible tube 43 is inserted into the inside of the waste liquid discharging nozzle 73, and thereby the waste liquid discharging nozzle 73 supports the downstream end part. In addition, the downstream end part of the flexible tube 43 is supported by the waste liquid discharging nozzle 73 such that the front end (downstream end) thereof is positioned to the front end of the waste liquid discharging nozzle 73. As a result, an opening is formed in the front end of the waste liquid discharging nozzle 73, and the waste ink is discharged from the opening. In other words, the waste liquid discharging nozzle 73 is a nozzle that is used for discharging the waste ink toward the inside of the waste ink tank 27.

The waste ink tank 27 is for housing the waste ink that is discharged from the front end opening of the waste liquid discharging nozzle 73 and has a box-shaped container unit 44, which is an approximate rectangular parallelepiped, as its primary constituent element. Inside the container unit 44, a waste ink storing space 47 that is used for storing the housed waste ink is formed (for example, see FIG. 4). In addition, in one end part of the container unit 44 in the longitudinal direction, an insertion hole 57 that is used for inserting the waste liquid discharging nozzle 73 is formed (for example, see FIG. 4). In a state in which the waste liquid discharging nozzle 73 is inserted into the insertion hole 57, and the front end opening is located in a predetermined position inside the waste ink storing space 47, the waste ink tank 27 is connected to the waste liquid discharging nozzle 73, and accordingly, the waste ink tank 27 can house the waste ink.

The waste ink tank 27 according to this embodiment can be replaced by being detached from and attached to the printer main body 11*a*. In other words, in the printer main body 11*a*, an installation position 31 for the waste ink tank 27 is located. Thus, in order to install the waste ink tank 27 to the printer main body 11*a*, the waste ink tank 27 is moved to the installation position 31 and is set in the installation position 31. On the other hand, in order to detach the waste ink tank 27 from the printer main body 11*a*, the waste ink tank 27 that is set in the installation position 31 is detached from the installation position 31. In addition, the printer main body 11*a* is a part (that is, the printer 11 in a state from which the waste ink tank 27 is detached) that is acquired by excluding the waste ink tank 27 from the printer 11 and corresponds to the main body of the waste liquid discharging device.

When the waste ink tank 27 is attached to or detached from the printer main body 11*a*, the waste liquid discharging nozzle 73 is inserted into or extracted from the insertion hole 57. In other words, in order to attach or detach the waste ink tank 27 to or from the printer main body 11*a*, the waste ink tank 27 is moved relative to the waste liquid discharging nozzle 73. By inserting or extracting the waste liquid discharging nozzle 73 into or from the insertion hole 57, the waste liquid discharging nozzle 73 is connected to or disconnected from the waste ink tank 27. Therefore, according to this embodiment, by moving the waste ink tank 27 relative to the waste liquid discharging nozzle 73, the connection state therebetween can be switched in an easy manner.

The housing unit 26 is an approximate rectangular-parallelepiped casing that is disposed in a position to the lower side of the home position HP. Inside the housing unit 26, a housing chamber 30 that houses a waste liquid collecting system 29 is formed. In other words, in the housing chamber 30, the waste ink tank 27 that is installed to the printer main body 11*a* is housed, and accordingly, the waste ink tank 27 is installed to the printer main body 11*a* inside the housing chamber 30. In other words, inside the housing chamber 30, the installation position 31 for the waste ink tank 27 is set. Thus, for installing the waste ink tank 27 to the printer main body 11*a*, the waste ink tank 27 is placed into the inside of the housing chamber 30 and is pushed up to the installation position 31.

Here, when the waste ink tank 27 is pushed into the housing chamber 30 for installing the waste ink tank 27 to the printer main body 11*a*, the waste ink tank 27 is pushed from the front side in the longitudinal direction of the housing unit 26 to the back side. Accordingly, the installation direction (a direction in which the waste ink tank 27 is moved toward the installation position 31) for installing the waste ink tank 27 to the printer main body 11*a* is the same as the longitudinal direction of the housing unit 26. The longitudinal direction of the housing unit 26 is a direction corresponding to the transport direction of the recording sheet P (see FIG. 2) which is the horizontal direction. Accordingly, the installation direction according to this embodiment is the horizontal direction.

The structures of the waste liquid collecting system 29 and the housing unit 26 will be described in detail in the next section.

Structures of Waste Liquid Collecting System 29 and Housing Unit 26

Hereinafter, the structures of the waste liquid collecting system 29 and the housing unit 26 that are described above will be described.

Structure of Waste Ink Tank 27

Figure 4:
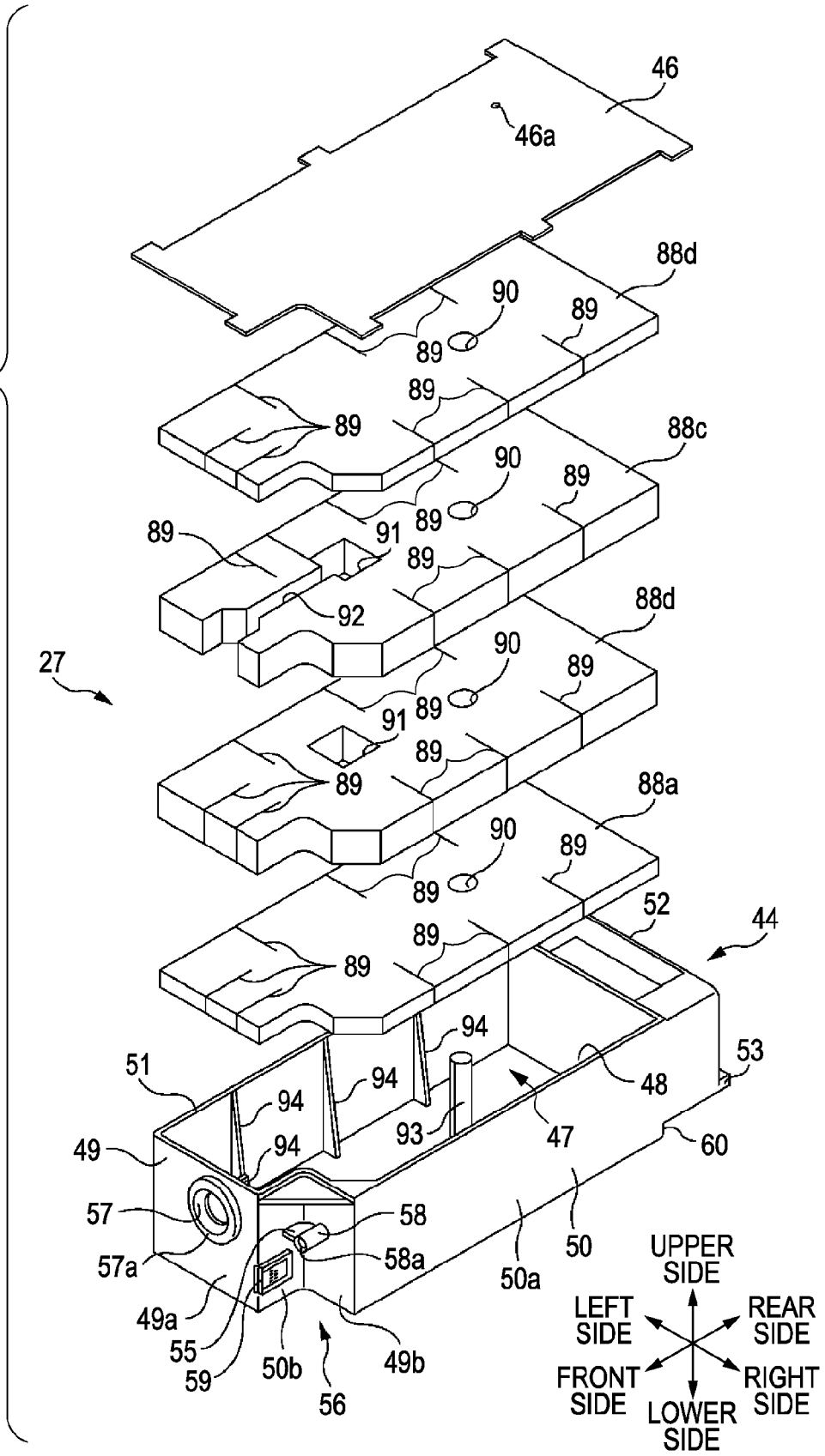
FIG. 4 is an exploded perspective view of a waste ink tank 27 according to an embodiment of the invention.
Figure 5A:
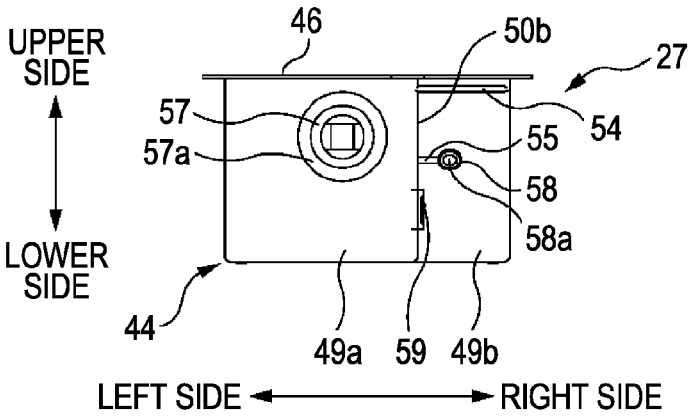
FIGS. 5A to 5C are a front view, a plan view, and a side view of the waste ink tank 27.
Figure 5B:
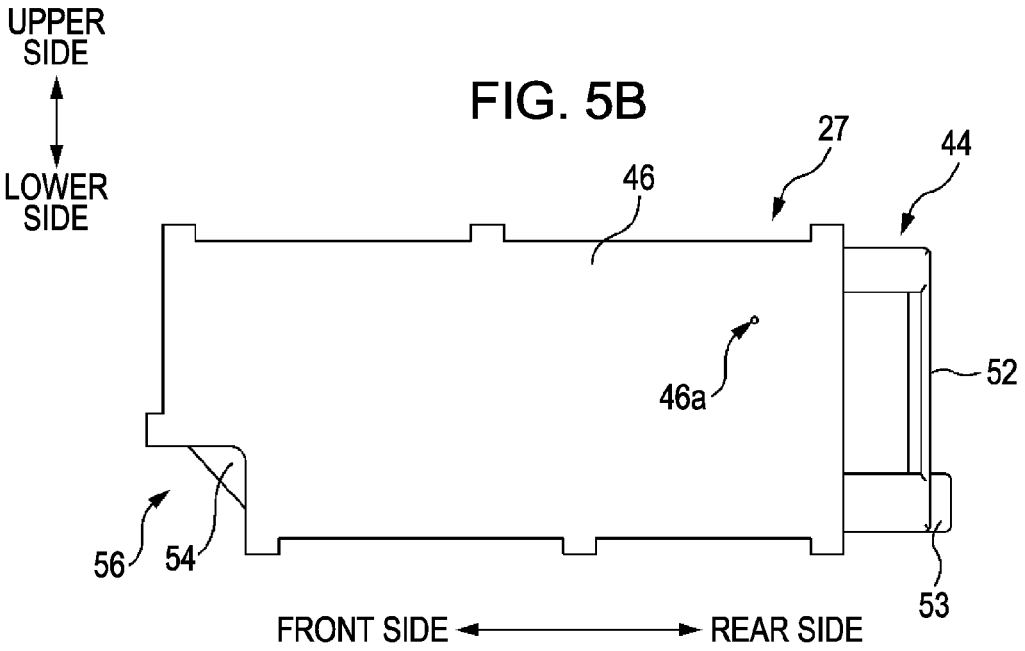
Figure 5C:
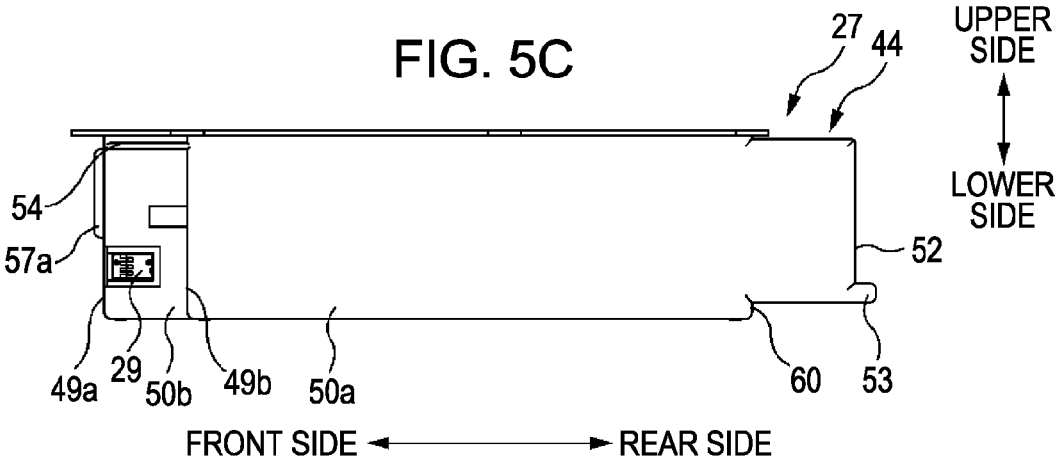

First, the structure of the waste ink tank 27 of the waste liquid collecting system 29 will be described with reference to FIG. 4 and FIGS. 5A to 5C. FIG. 4 is an exploded perspective view of the waste ink tank 27. FIGS. 5A to 5C are a front view, a plan view, and a side view of the waste ink tank 27.

In the above-described drawings, the upper and lower directions, the front and rear directions, and the left and right directions of the waste ink tank 27 are denoted by arrows. Here, the upper and lower directions are the upper and lower directions of the waste ink tank 27 that is installed to the printer main body 11*a*. In addition, the front and rear directions are directions corresponding to the installation direction for installing the waste ink tank 27 to the printer main body 11*a*. Hereinafter, for a case where the waste ink tank 27 is installed to the printer main body 11*a*, a side located on the front side of the waste ink tank 27 is referred to as the front side, and a side located on the rear side of the waste tank 27 is referred to as the rear side. In addition, a side located on the left side, viewed from the front side of the waste ink tank 27 is referred to as the left side, and a side located on the right side, viewed from the front side of the waste ink tank 27 is referred to as the right side.

The container unit 44 of the waste ink tank 27, as shown in FIG. 4, has the bottom and includes a front wall 49, a right wall 50, a left wall 51, and a rear wall 52 as side walls. In addition, in the upper end face of the waste ink tank 27, an opening 48 is formed. Inside the container unit 44 having such a structure, the above-described waste ink storing space 47 is formed. The waste ink tank 27 according to this embodiment includes a plurality of (in this embodiment, four) ink absorbers 88*a*, 88*b*, 88*c*, and 88*d* inside the waste ink storing space 47. In addition, as shown in FIG. 4, the ink absorbers 88*a*, 88*b*, 88*c*, and 88*d* are housed in a laminated state inside the waste ink storing space 47.

The ink absorbers 88*a*, 88*b*, 88*c*, and 88*d* according to this embodiment are formed of high-density fiber structured polyurethane such as pelt. However, the ink absorbers 88*a*, 88*b*, 88*c*, and 88*d* may be formed of different materials. Thus, for example, the ink absorbers may be formed of water absorption paper or a foam forming material such as cellulose, polyvinyl alcohol, or ethylene vinyl acetate. In addition, a material containing water absorption high-molecular polymer such as acrylic acid graft starch, acrylic salt graft starch, vinyl alcohol acrylic acid block copolymer, cross-linked poly acrylic acid, cross-linked polyacrylic salt, modified polyvinyl alcohol, polystyrene sulfonic acid, cellulose ether, or carboxymethyl cellulose may be used.

Each ink absorber 88*a*, 88*b*, 88*c*, or 88*d*, as shown in FIG. 4, has the outer diameter shape that is almost the same as that of the opening 48. In the outer edge of each ink absorber, a plurality of notches 89 is formed. In addition, in a position located on a slightly rear side from the center of each ink absorber 88*a*, 88*b*, 88*c*, or 88*d*, a column hole 90 having a round hole shape is formed through penetration. When each ink absorber 88*a*, 88*b*, 88*c*, or 88*d* is housed in the container unit 44 in a laminated state, support ribs 94 to be described later intrude the notches 89, and a cylinder part 93 to be described later is inserted into the column hole 90. Accordingly, the positions of the ink absorbers 88*a*, 88*b*, 88*c*, or 88*d* inside the container unit 44 are determined.

In addition, as shown in FIG. 4, among the ink absorbers 88*a*, 88*b*, 88*c*, and 88*d* that are laminated inside the container unit 44, in the ink absorber 88*b* located second from the lower side and the ink absorber 88*c* located third from the lower side, square-shaped holes 91 are formed in positions located on a slightly front side from the center. These square-shaped holes 91 are discharge places for the waste ink discharged from the front end opening of the waste liquid discharging nozzle 73, that is, a discharge opening of the waste ink. The waste ink discharged into the square-shaped holes 91 penetrates into the ink absorbers 88*a*, 88*b*, 88*c*, and 88*d* from the square-shaped holes 91 and diffuses into the inside of the ink absorbers 88*a*, 88*b*, 88*c*, and 88*d* so as to be absorbed and maintained well. In addition, in the ink absorber 88*c* located third from the lower side, a cut groove 92 having a predetermined width is formed from the front end toward the square-shaped hole 91 in the front-rear direction. This cut groove 92 is a groove that is used for passing through the waste liquid discharging nozzle 73. Thus, by passing the waste liquid discharging nozzle 73 through the cut groove 92, the front end of the waste liquid discharging nozzle 73 can be positioned inside the square-shaped hole 91 that is formed in the ink absorber 88*c* located third from the lower side.

To the upper end face of the container unit 44, as shown in FIGS. 4 and 5B, a gas-liquid impermeable film member 46 wider than the opening 48 is attached for sealing the opening 48 of the container unit 44 in which the ink absorbers 88*a*, 88*b*, 88*c*, and 88*d* are housed. By this film member 46, a decrease of the absorption capability of the ink absorbers 88*a*, 88*b*, 88*c*, and 88*d* is suppressed. Described in more details, when the solvent contained in the waste ink that is absorbed and maintained in the ink absorbers 88*a*, 88*b*, 88*c*, and 88*d* is evaporated, ink residue is generated in the ink absorbers 88*a*, 88*b*, 88*c*, and 88*d*. Here, when the opening 48 is open, the ink residue can be easily fixed on the surfaces of the ink absorbers 88*a*, 88*b*, 88*c*, and 88*d*. As a result, the absorption capability of the ink absorbers 88*a*, 88*b*, 88*c*, and 88*d* is decreased. On the other hand, according to this embodiment, since the opening 48 is sealed by the film member 46, the fixation of the ink residue is suppressed, and thereby the decrease of the absorption capability of the ink absorbers 88*a*, 88*b*, 88*c*, and 88*d* is suppressed. Furthermore, the opening 48 is sealed by the film member 46. Thus, when a user using the printer 11 attaches or detaches the waste ink tank 27 to or from the printer main body 11*a*, it can be suppressed that a hand or the like of the user using the printer 11 who is an operator gets dirty. In addition, as shown in FIGS. 4 and 5B, an ink evaporation hole 46*a* is formed in the film member 46. In this embodiment, the ink evaporation hole 46*a* is formed in a distant position from the front end opening of the waste liquid discharging nozzle 73 in a state in which the waste ink tank 27 is set in the installation position 31. In particular, as shown in FIGS. 4 and 5B, the ink evaporation holes 46*a* is formed near the left side of the rear end of the film member 46. Since the ink evaporation hole 46*a* is formed in such a position, the solvent contained in the waste ink absorbed in the ink absorbers 88*a*,

88*b*, 88*c*, and 88*d* is intensively evaporated from positions that are distant from the front end opening of the waste liquid discharging nozzle 73 so as to be discharged to the outside of the waste ink tank 27. As a result, diffusion of the waste ink is promoted inside the ink absorbers 88*a*, 88*b*, 88*c*, and 88*d*.

The position for forming the ink evaporation hole 46*a* is not limited to the above-described position. For example, the ink evaporation hole 46*a* may be formed to be positioned right above the front end opening of the waste liquid discharging nozzle 73 in a state in which the waste ink tank 27 is set in the installation position 31. In addition, a member that seals the opening 48 is not limited to the film member 46. For example, a lid member that is acquired through resin molding may be used as the above-described member. In addition, a member that seals the opening 48 during only a period in which the waste ink tank 27 is set in the installation position 31 may be disposed. Alternatively, the opening 48 may be configured not to be sealed. Furthermore, a hollow container unit 44 in which the opening 48 is not formed may be used.

In a corner part located on the right front side of the container unit 44, as shown in FIGS. 4 and 5B, a depressed part 56 having a letter "L" shape viewed from the upper side is formed. As a result, the front wall 49 is divided into a main front wall 49*a* that is relatively located on the front side and a sub front wall 49*b* that is relatively located on the rear side. Similarly, the right wall 50 is divided into a main right wall 50*a* that is relatively located on the right side and a sub right wall 50*b* that is relatively located on the left side. The sub front wall 49*b* and the sub right wall 50*b* are located adjacent to each other so as to be intersected with each other approximately perpendicularly. As shown in FIGS. 4 and 5B, between the sub front wall 49*b* and the sub right wall 50*b*, a reinforcement rib 54 having an approximate triangle shape which is used for reinforcing the depressed part 56 is installed.

In the upper part of the main front wall 49*a*, as shown in FIGS. 4 and 5A, the above-described insertion hole 57 is formed through the main front wall 49*a*. The insertion hole 57 is a round hole into which the waste liquid discharging nozzle 73 is inserted through. The insertion hole 57 is communicated with the cut groove 92 that is formed in the ink absorber 88*c* located third from the lower side, in a state in which the ink absorbers 88*a*, 88*b*, 88*c*, and 88*d* are housed in the container unit 44. In addition, according to this embodiment, the inner-side opening of the insertion hole 57 is wider than the opening of the cut groove 92. Accordingly, as shown in FIG. 5A, an inner part of the opening of the insertion hole 57 is blocked by the front end face of the ink absorber 88*c* located third from the lower side, in a state in which the ink absorbers 88*a*, 88*b*, 88*c*, and 88*d* are housed in the container unit 44.

The insertion hole 57 is fitted to a large diameter portion 73*a* (the large diameter portion 73*a* will be described later) of the waste liquid discharging nozzle 73 when the waste ink tank 27 is installed to the printer main body 11*a*, and whereby the insertion hole 57 determines the position of the waste ink tank 27 in the diameter direction of the large diameter portion 73*a* with respect to the printer main body 11*a*, in cooperation with the large diameter portion 73*a*. The insertion hole 57 according to this embodiment is formed such that the inner face of the insertion hole 57 is brought into contact with the outer circumferential face of a small diameter portion 73*c* during a period in which the small diameter portion 73*c* (the small diameter portion 73*c* will be described later) of the waste liquid discharging nozzle 73 passes through the inside of the insertion hole 57. In addition, the insertion hole 57 is formed to have the aperture of the opening gradually decreasing from the opening edge 57*a* toward the inner part, so that the front end of the waste liquid discharging nozzle can be easily led to the center of the inner part of the insertion hole 57.

In addition, according to this embodiment, as shown in FIG. 5C, the opening edge 57*a* of the insertion hole slightly protrudes from the main front wall 49*a*, and accordingly, the front-side opening of the insertion hole 57 is located to the front side relative to the front face of the main front wall 49*a* in the front-rear direction. However, a configuration in which the front-side opening of the insertion hole 57 and the front face of the main front wall 49*a* are located in a same position in the front-rear direction may be used. In addition, the insertion hole 57 is configured as a round hole. However, the insertion hole may be a differently shaped hole such as a triangle-shaped hole or a square-shaped hole, as long as the insertion hole 57 determines the position of the waste ink tank 27, in cooperation with the large diameter portion 73*a* of the waste liquid discharging nozzle 73.

In each inner face of the front wall 49, the right wall 50, and the left wall 51 of the container unit 44, as shown in FIG. 4, the plurality of support ribs 94 forming a thin plate shape is formed along the upper-lower direction. Each support rib 94 is formed in correspondence with a cut depth 89 formed on the outer frame of each ink absorber 88*a*, 88*b*, 88*c*, or 88*d*. In addition, as shown in FIG. 4, on the inner bottom face of the container unit 44, the cylinder part 93 is installed in a rear position relative to the center. The cylinder part 93 is inserted into the column hole 90 that is formed in each ink absorber 88*a*, 88*b*, 88*c*, or 88*d*.

In a position of the container unit 44 that is located slightly to the front-end side relative to the rear end of the bottom face, as shown in FIGS. 4 and 5C, a stair part 60 is formed to extend from the left end of the container unit 44 to the right end thereof. The stair part 60 is formed so as to determine the position of the waste ink tank 27 in the horizontal direction with respect to the printer main body 11*a*. In particular, the stair part 60 is engaged with a locking stair portion 40 that is formed on the bottom wall 32 of the housing unit 26 (see FIG. 3). In addition, in the lower end of the rear wall 52 of the container unit 44, as shown in FIGS. 4, 5B, and 5C, a lead-out part 53 that is led out toward the rear side is formed to slightly extend from the left end of the rear wall 52 toward the right end thereof. The lead-out part 53 is formed for suppressing lift of the rear end part of the waste ink tank 27 to the upper side due to an external force or the like. In particular, the lead-out part 53 is engaged with a locking protrusion 45 that protrudes from the rear face of an opening and closing door 36 of the housing unit 26 (see FIG. 3).

On the sub front wall 49*b*, as shown in FIG. 4, a tube part 58 having a cylindrical shape protrudes toward the rear side, and a position adjusting hole 58*a* is configured by a hole of the tube part 58. This position adjusting hole 58*a* is formed so as to suppress rotation of the waste ink tank 27 about the waste liquid discharging nozzle 73 (in other words, so as to determine the position of the waste liquid discharging nozzle 73 in the circumferential direction). In particular, a position adjusting pin 85 (for example, see FIG. 6) of the waste liquid discharging nozzle unit 28 is inserted into the position adjusting hole 58*a*. In addition, in order to reinforce the tube part 58, as shown in FIGS. 4 and 5A, a tube part reinforcing rib 55 is disposed between the outer circumferential face of the tube part 58 and the sub right wall 50*b*.

The position adjusting hole 58*a* according to this embodiment, as shown in FIG. 5A, is a long hole having an elliptic cross-section that has the major axis in the left-right direction. However, the position adjusting hole 58*a* is not limited thereto. Thus, the position adjusting hole 58*a* may be a hole having a different shape such as a hole having a square-shaped cross-section. In addition, the member that serves to stop rotation of the waste ink tank 27 is not limited to the position adjusting hole 58*a*. Thus, a rib-shaped member serving to stop the rotation by being engaged with a predetermined member of the printer main body 11*a* may be used. Alternatively, any member that serves to stop the rotation may not be disposed.

The waste ink tank 27, as shown in FIG. 4, includes a memory element 59 that stores various types of information on the amount of stored waste ink and the like. This memory element 59 is electrically connected to the printer controller 100 by being brought into contact with a contact point 87 (for example, see FIG. 6) that is prepared in the waste liquid discharging nozzle unit 28 in a state in which the waste ink tank 27 is set in the installation position 31. The memory element 59, as shown in FIGS. 4, 5A, and 5C, is mounted to a position on the outer face of the sub right wall 50*b* perpendicular to the main front wall 49*a*, in which the insertion hole 57 is formed, which is located on the lower side relative to the insertion hole 57. The reason is that the rigidity of the sub right wall 50*b* increases as the position is distanced further from the upper end in which the opening 48 is formed, and by attaching the memory element 59 to a position having relatively high rigidity, the state of contact between the memory element 59 and the contact point 87 can be maintained well. In addition, the sub right wall 50*b* is reinforced by the reinforcement rib 54, and accordingly, the state of contact can be maintained well. In addition, the memory element 59 is installed to be leaned to the left side in which the lead-out part 53 protrudes in the left-right direction and suppression of lift is more assuredly exhibited by the lead-out part 53. Accordingly, the state of contact can be maintained well. However, the attachment position of the memory element 59 is not limited to the above-described configuration. For example, the memory element 59 may be mounted on the main front wall 49*a*.

Structure of Waste Liquid Discharging Nozzle Unit 28

Hereinafter, the structure of the waste liquid discharging nozzle unit 28 of the waste liquid collecting system 29 will be described with reference to FIGS. 6, 7A, and 7B and FIGS. 8, 9A, and 9B.

Figure 6:
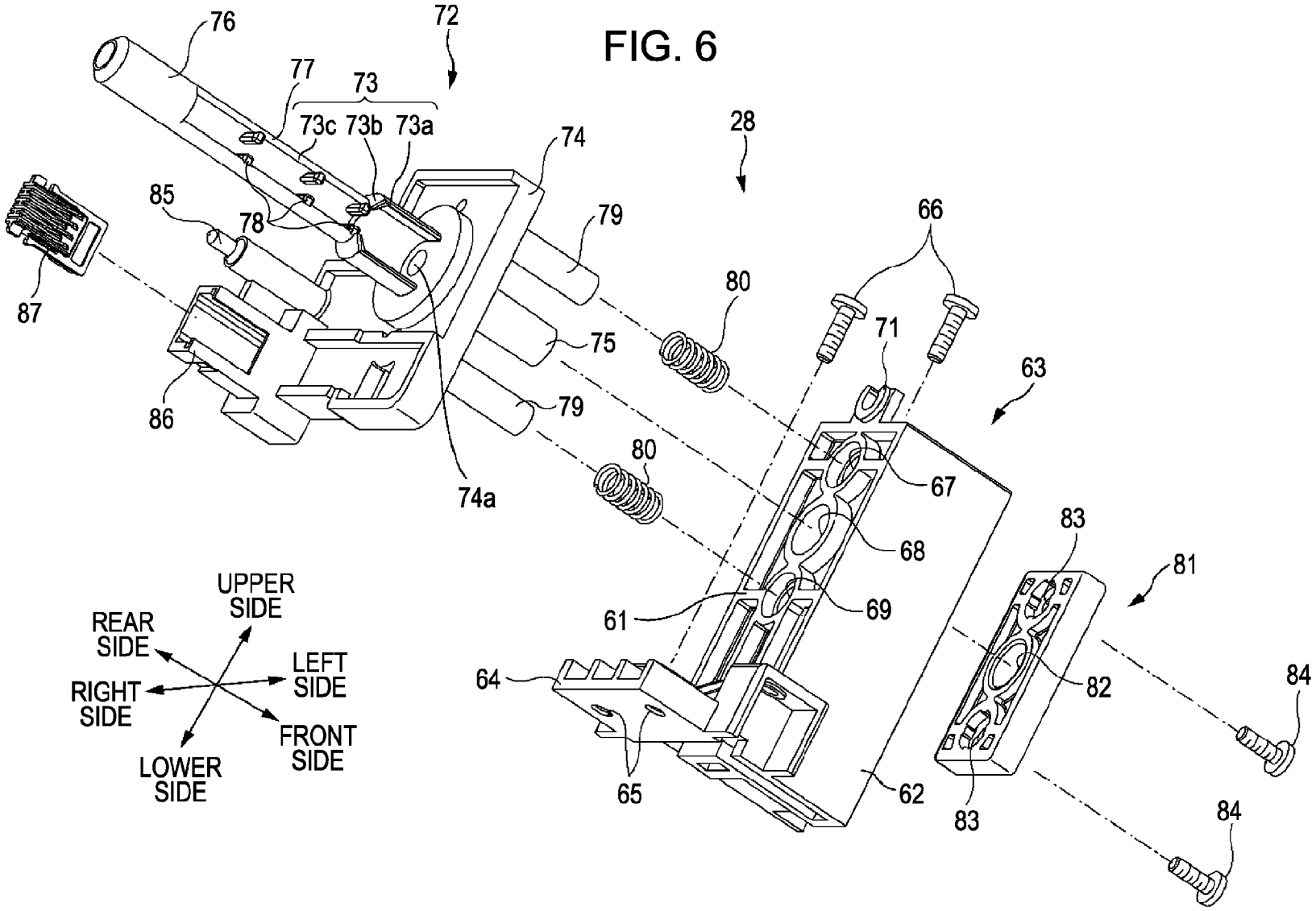
FIG. 6 is an exploded perspective view of a waste liquid discharging nozzle unit 28 according to an embodiment of the invention.
Figure 7A:
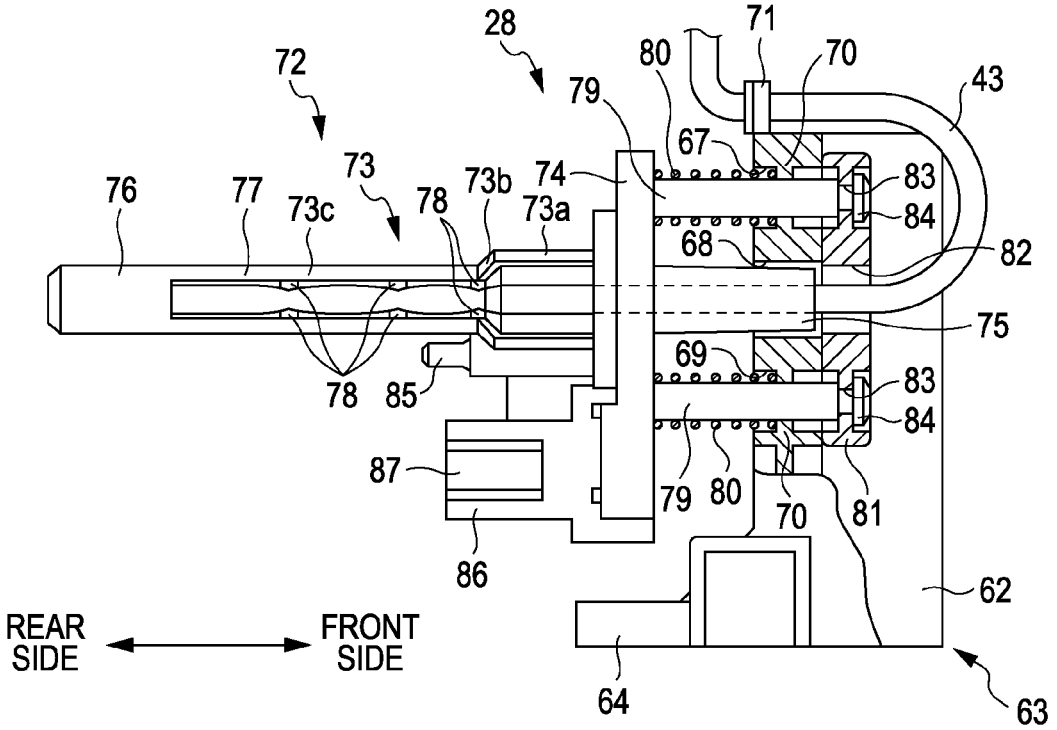
FIGS. 7A and 7B are side views of the waste liquid discharging nozzle unit 28 after assembly.
Figure 7B:
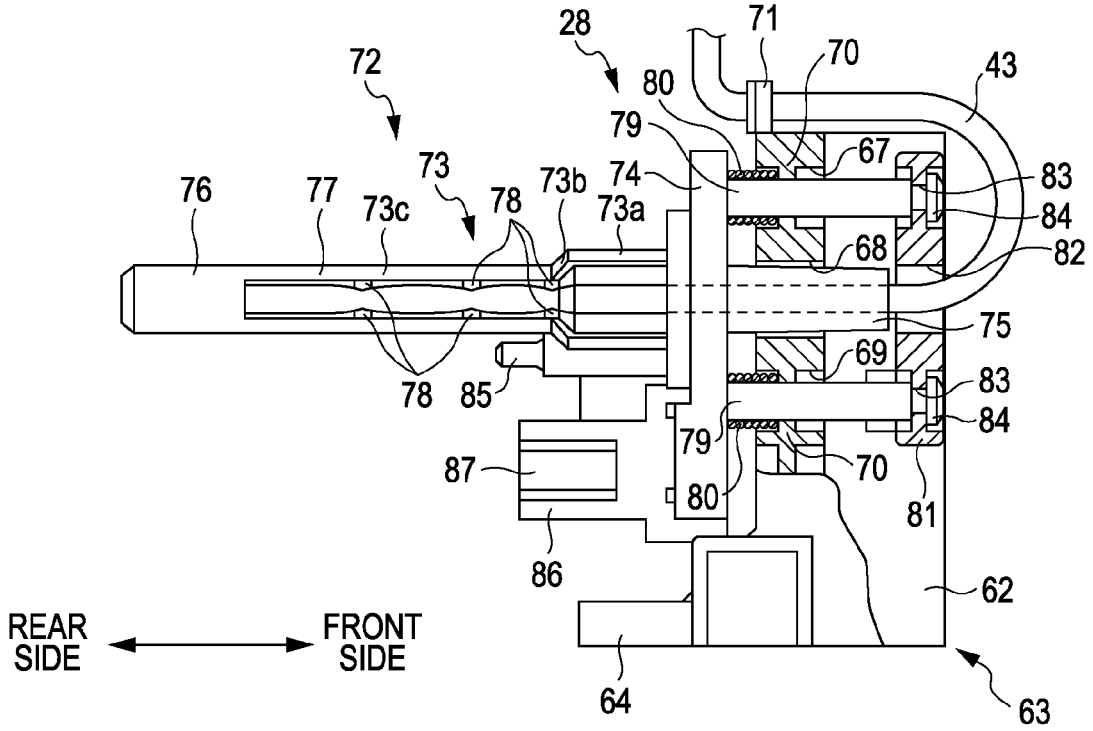
Figure 8:
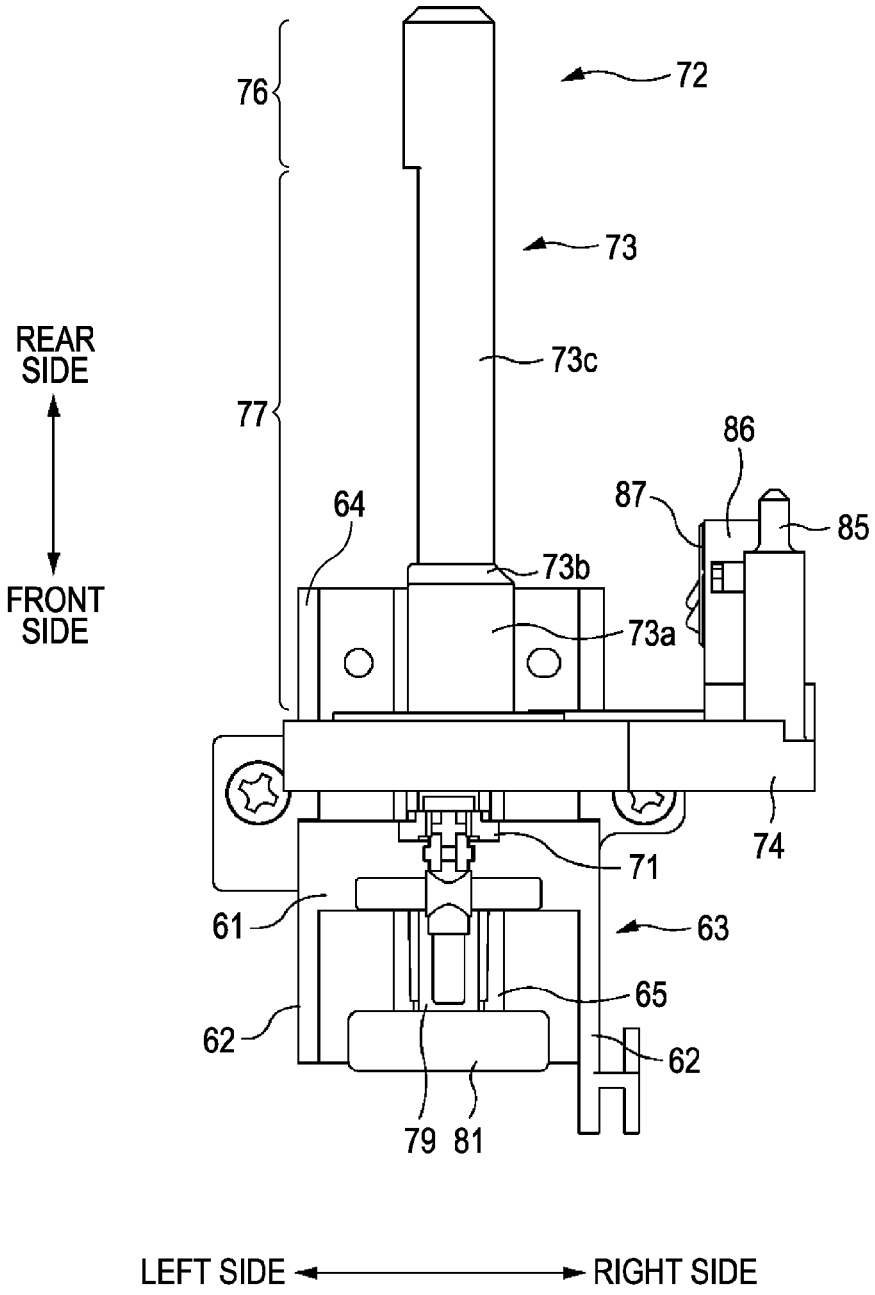
FIG. 8 is a plan view of the waste liquid discharging nozzle unit 28 shown in FIG. 7B, viewed from the upper side.
Figure 9A:
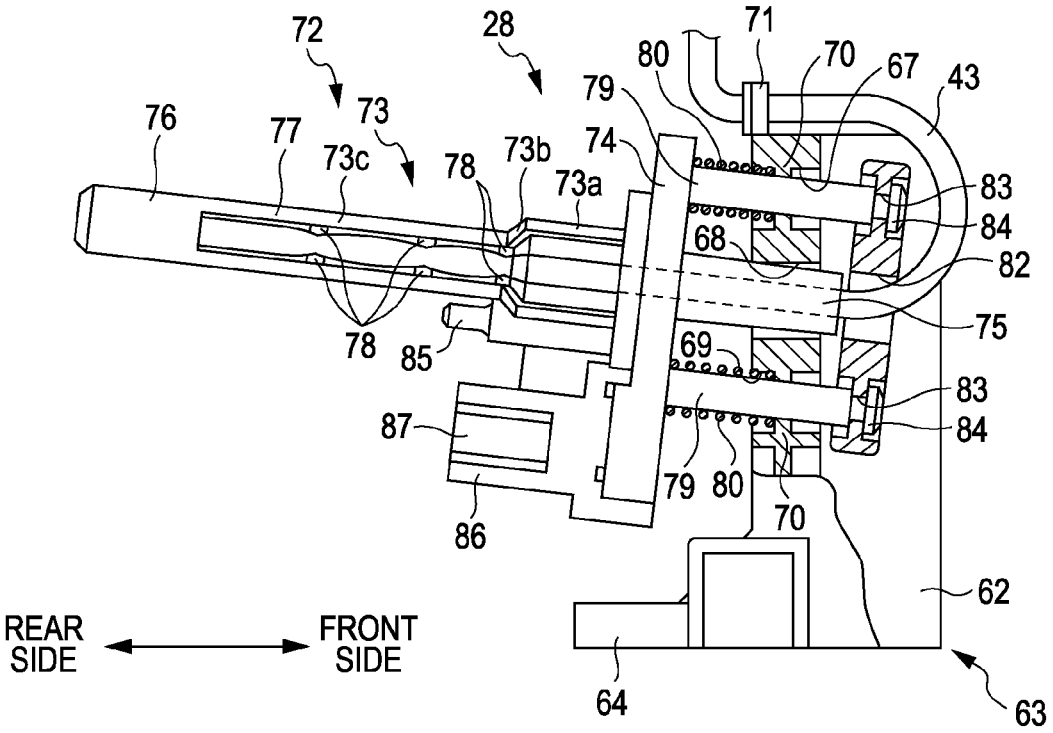
FIGS. 9A and 9B are diagrams showing appearance at a time when a nozzle part 72 oscillates vertically according to an embodiment of the invention.
Figure 9B:
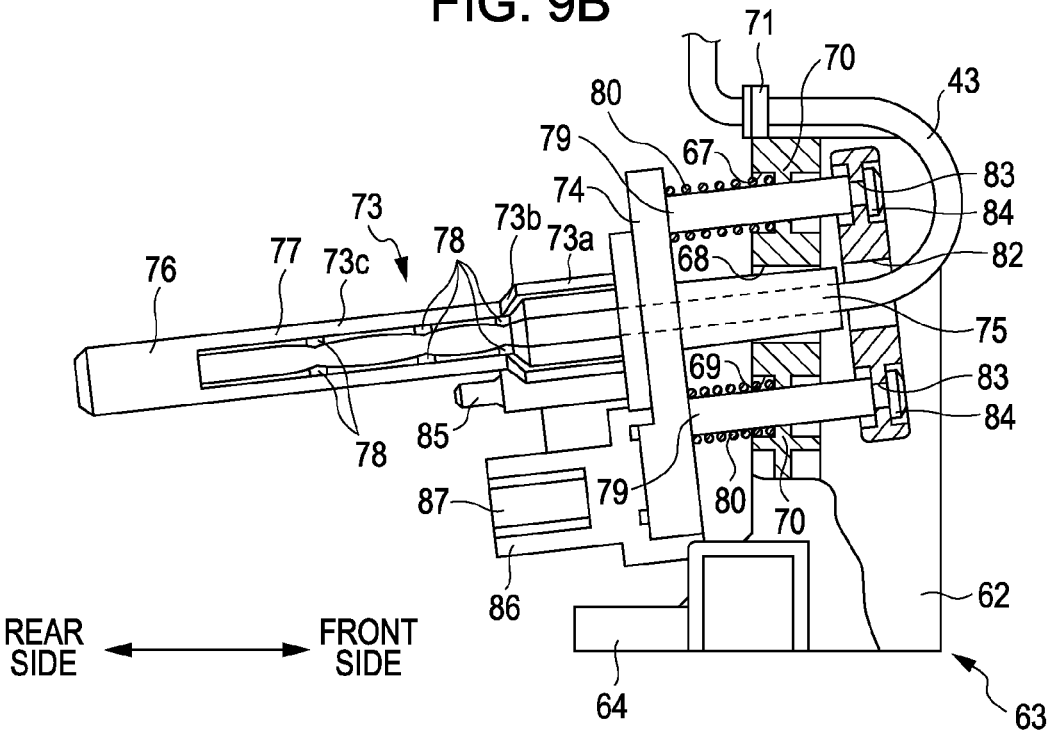

FIG. 6 is an exploded perspective view of the waste liquid discharging nozzle unit 28. FIGS. 7 to 9B are diagrams showing the waste liquid discharging nozzle unit 28 after assembly. FIGS. 7A and 7B are side views of the waste liquid discharging nozzle unit 28. For the convenience of description, parts of FIGS. 7A and 7B are cross-sectional views. FIG. 8 is a plan view of the waste liquid discharging nozzle unit 28 shown in FIG. 7B, viewed from the upper side. FIGS. 9A and 9B are diagrams showing appearance at a time when a nozzle part 72 oscillates vertically. As in FIGS. 7A and 7B, parts of FIGS. 9A and 9B are cross-sectional views.

In the above-described drawings, the upper and lower directions, the front and rear directions, and the left and right directions of the waste liquid discharging nozzle unit 28 are denoted by arrows. Here, the upper and lower directions, the front and rear directions, and the left and right directions of the waste liquid discharging nozzle unit 28 are in correspondence with the upper and lower directions, the front and rear directions, and the left and right directions of the waste ink tank 27. In descriptions below, a side located on a relatively back side, viewed from the waste ink tank 27 in the middle of an assembly operation for the printer main body 11*a* is referred to as the front side of the waste liquid discharging nozzle unit 28. On the other hand, a side located on a relatively front side is referred to as the rear side of the waste liquid discharging nozzle unit 28. In addition, a side located on the left side, viewed from the front side of the waste liquid discharging nozzle unit 28 is referred to as a left side, and a side located on the right side is referred to as the right side.

The waste liquid discharging nozzle unit 28, as shown in FIGS. 6 to 9B, is configured by a nozzle part 72 that includes a waste liquid discharging nozzle 73 and a base part 63 that supports the nozzle part 72. The waste liquid discharging nozzle unit 28 is fixed to the inside of the housing chamber 30 of the housing unit 26 so as to be housed in the housing chamber 30. In order to fix the waste liquid discharging nozzle unit 28 to the inside of the housing chamber 30, in a lower part of the rear end of the base part 63, a horizontal plate part 64 having a rectangular plate shape in which one pair of screw holes 65 including left and right screw holes is formed is disposed. As the waste liquid discharging nozzle unit 28 is stopped in the screw holes 65 and screws 66 are screwed into the screw holes 65, the waste liquid discharging nozzle unit 28 is fixed to the bottom wall 32 of the housing unit 26 (see FIG. 3).

The nozzle part 72 is a member acquired through a resin molding process and is located on the rear side of the base part 63. This nozzle part 72, as shown in FIG. 6, includes a waste liquid discharging nozzle 73, a guard part 74, and a tube guiding part 75 in the order from the rear side (front side) in the front-rear direction.

The waste liquid discharging nozzle 73, as described above, can be inserted into or extracted from the insertion hole 57 of the waste ink tank 27. The length of the waste liquid discharging nozzle 73 in the axis direction is such a length that the front end of the waste liquid discharging nozzle 73 is located inside the square-shaped hole 91 that is formed in the ink absorber 88*c* located third from the lower side, in a state in which the waste ink tank 27 is set in the installation position 31. As shown in FIG. 6, the waste liquid discharging nozzle 73 includes the large diameter portion 73*a*, a taper part 73*b*, and the small diameter portion 73*c* in the order from the front side (back side) in the front-rear direction. The large diameter portion 73*a*, the taper part 73*b*, and the small diameter portion 73*c* are aligned such that center axes thereof coincide with one another. Thus, the center axes thereof form the center axis of the waste liquid discharging nozzle 73.

The large diameter portion 73*a* of the waste liquid discharging nozzle 73 is a part having a same outer diameter as the aperture of the inner side of the insertion hole 57. When the waste ink tank 27 is moved toward the installation position 31 in a state in which the waste liquid discharging nozzle 73 is inserted into the insertion hole 57, finally, the insertion hole 57 is fitted to the large diameter portion 73*a*.

The small diameter portion 73*c* is located on the forefront end side of the waste liquid discharging nozzle 73 (that is, located on the front end side relative to the large diameter portion 73*a*). The small diameter portion 73*c* is a part having an outer diameter smaller than the aperture of the inner side of the insertion hole 57. Accordingly, when the waste liquid discharging nozzle 73 is inserted into the insertion hole 57, the small diameter portion 73*c* is loosely inserted into the insertion hole 57 during a period in which the small diameter portion 73*c* passes the inside of the insertion hole 57. As shown in FIG. 6, the front end part (the end part on the rear side) of the small diameter portion 73*c* according to this embodiment is tapered. The taper part 73*b* is formed to have an outer diameter gradually increasing toward the front side (the large diameter 73*a* side) from the rear side (the small diameter portion 73*c* side).

In addition, in the waste liquid discharging nozzle 73, as shown in FIG. 6, a complete cylindrical area 76 that forms a complete cylindrical shape and an incomplete cylindrical area 77 that is located on the base side relative to the complete cylindrical area 76 and has a peripheral wall of which an approximate half is cut away are formed in the front end (the rear end in the front-rear direction).

The incomplete cylindrical area 77 is a part of the waste liquid discharging nozzle 73 that supports the flexible tube 43 by fixing the flexible tube 43 by using fixing parts 78 disposed on the inner face thereof. The fixing part 78 according to this embodiment is a pair of pinching claws. The gap between the fixing parts 78 forming a pair is slightly smaller than the outer diameter of the flexible tube 43, and accordingly, the flexible tube 43 is fixed by disposing the flexible tube 43 between lateral sides to be pinched. The fixing parts 78 are disposed in a plurality of spots (in this embodiment, three spots) in the front-rear direction. The complete cylindrical area 76 has the internal diameter that is the same as the outer diameter of the flexible tube 43. The complete cylindrical area 76 is a part of the waste liquid discharging nozzle 73 that supports the downstream end part by being fitted into the downstream end part of the flexible tube 43. Although both the complete cylindrical area 76 and the incomplete cylindrical area 77 are formed in the waste liquid discharging nozzle 73 according to this embodiment, only one between the two areas may be formed.

By the waste liquid discharging nozzle 73, the downstream end part of the flexible tube 43 is supported in an approximate straight line along the axis direction of the waste liquid discharging nozzle 73. In other words, the flexible tube 43 that is unstable and easily flexible is supported by the waste liquid discharging nozzle 73 appropriately. Accordingly, the downstream end of the flexible tube 43, that is, a discharge opening of the waste ink can be connected to the waste ink tank 27 in an easy manner. In addition, the complete cylindrical area 76 that supports the downstream end of the flexible tube 43 is formed to be positioned in the forefront end of the waste liquid discharging nozzle 73. Accordingly, the downstream end of the flexible tube 43 that is the discharge opening of the waste ink is disposed in the front end of the waste liquid discharging nozzle 73. Accordingly, discharge of the waste ink can be performed well. In addition, the downstream end part of the flexible tube 43 is supported in an approximate straight line, the downstream end of the flexible tube 43 can be disposed in a predetermined position inside the waste ink tank 27 in an easy manner. As a result, for example, the waste ink can be discharged in the predetermined position.

The guard part 74 is an approximate plate shaped body that is integrally formed with the waste liquid discharging nozzle 73. This guard part 74 is brought into contact with the opening edge 57*a* of the insertion hole 57 of the waste ink tank 27 on the rear end face of the guard part 74, in a state in which the waste ink tank 27 is set in the installation position 31. In addition, as shown in FIGS. 6 and 8, in a right edge of the rear side of the guard part 74, the position adjusting pin 85 that can be inserted into or extracted from the position adjusting hole 58*a* of the tube part 58 of the waste ink tank 27 protrudes. In addition, right below the position adjusting pin 85, a vertical plate part 86 that forms a rectangular plate shape is formed to protrude toward the front side. On one side face (left side face) of the vertical plate part 86, as shown in FIGS. 6 and 8, the contact point 87 that is brought into contact with the memory element 59 of the waste ink tank 27 is mounted.

The tube guiding part 75 is a cylindrical body that protrudes from the center of the front face of the guard part 74 and is used for guiding the flexible tube 43 into the inside of the waste liquid discharging nozzle 73 from the base part 63. In other words, the inner space of the tube guiding part 75 is communicated with the inner space of the waste liquid discharging nozzle 73 through a hole 74*a* that is formed in the guard part 74. In addition, the tube guiding part 75 is inserted into a center through hole 68 of the base part 63 to be described later, and thus, the internal diameter of the tube guiding part 75 is formed to have a diameter for passing through the flexible tube 43. After being inserted into the tube guiding part 75 in a state in which the tube guiding part 75 is inserted into the center through hole 68, the flexible tube 43 is guided to the inside of the waste liquid discharging nozzle 73 though the tube guiding part 75. In addition, the tube guiding part 75 may not be a complete cylindrical body. Thus, like the incomplete cylindrical area 77 that is formed in the waste liquid discharging nozzle 73, the tube guiding part 75 may have a peripheral wall of which a part is cut away. In such a case, it is preferable that a fixing part 78 having a pinching claw shape is disposed on the inner face of the tube guiding part 75.

As shown in FIG. 6, on the front face of the guard part 74, one pair of cylinder parts 79 including upper and lower cylinder parts protrudes toward the front side from two spots, which includes upper and lower spots, of the tube guiding part 75. This one pair of cylinder parts 79 are used for supporting the nozzle part 72 by the base part 63, in cooperation with the tube guiding part 75. For the nozzle part 72 to be supported by the base part 63, the upper cylinder part 79 is inserted into the upper through hole 67 of the base part 63 to be described later, and the lower cylinder part 79 is inserted into the lower through hole 69 to be described later. In addition, on the front end face of each cylinder part 79, a screw hole (not shown) is formed.

The base part 63, as shown in FIG. 8, is a member having an approximate "Π" shape viewed from the upper side. The base part 63 includes a rear wall 61 and a side wall 62 that extends from both the left and right ends of the rear wall 61 toward the front side. In an approximate center position of the upper end of the rear wall 61 of the base part 63, a tube fixing part 71 having an approximate letter "U" shape that supports the flexible tube 43 by pinching the flexible tube 43 is formed. In this embodiment, although one tube fixing part 71 is disposed, a plurality of the tube fixing parts 71 may be disposed in the front-rear direction.

In addition, on the rear wall 61 of the base part 63, as shown in FIG. 6, a plurality of (in this embodiment, three) though holes is formed to be aligned in the upper-lower direction. Among the plurality of through holes, the center through hole 68 is formed to have the aperture larger than the outer diameter of the tube guiding part 75. In addition, the center through hole 68 is formed such that the center axis of the center through hole 68 is the same as the center axis of the insertion hole 57 of the waste ink tank 27 in a state in which the waste ink tank 27 is set in the installation position 31 located inside the housing chamber 30.

The upper through hole 67 and the lower through hole 69 are formed to have the aperture larger than the diameter of a corresponding cylinder part 79. In addition, as shown in FIGS. 7A and 7B, in a center position between the upper through hole 67 and the lower though hole 69, a flange part 70 that is led out toward the inner side is formed. Into the upper through hole 67 and the lower through hole 69, as described above, corresponding cylinder parts 79 are inserted. At this moment, as shown in FIG. 6, through a peripheral face of each of the upper through hole 67 and the lower through hole 69, a coil spring 80 as a biasing member is installed. In the state in which the cylinder part 79 through which the coil spring 80 is installed is inserted into a corresponding through hole (that is, the upper through hole 67 and the lower through hole 69), the front end of the coil spring 80 is brought into contact with the flange part 70 that is mounted on the inner circumferential faces of the upper through hole 67 and the lower through hole 69, and the rear end of the coil spring 80 is brought into contact with the front face of the guard part 74. In addition, since the coil spring 80 is included inside the waste liquid discharging nozzle unit 28, the coil spring 80 is included in the printer main body 11*a*.

On the front side of the base part 63, as shown in FIG. 6, an assembly plate 81 having a rectangular shape which is used for assembling the nozzle part 72 and the base part 63 is disposed. The assembly plate 81, as shown in FIG. 8, is installed so as to be disposed between one pair of left and right side walls 62 of the base part 63. As shown in FIG. 6, in the center part of the assembly plate 81, an assembly plate-side through hole 82 corresponding to the center through hole 68 of the base part 63 is formed. In addition, on the upper side and the lower side of the assembly-side through hole 82, screw passing holes 83 corresponding to the upper through hole 67 and the lower through hole 69 of the base part 63 are formed.

Then, setscrews 84 that pass through the screw passing holes 83 are screwed with the screw holes that are formed on the front end faces of the cylinder parts 79 in a state in which the cylinder parts 79 are inserted into the upper through hole 67 and the lower through hole 69 of the base part 63. Accordingly, the assembly plate 81 is installed to the main body (a part of the base part 63 other than the assembly plate 81) of base part 63, and the nozzle part 72 is assembled with the base part 63.

Hereinafter, assembly of the waste liquid discharging nozzle unit 28 having the above-described constituent elements will be described.

First, after passing the downstream end of the flexible tube 43 through the assembly plate-side though hole 82 of the assembly plate 81 from the front side, the downstream end of the flexible tube 43 is passed through the center through hole 68 of the rear wall 61 of the base part 63 from the front side and is extracted from the center though hole 68 to the rear side to some degree.

Next, the downstream end of the flexible tube 43 shown up from the center though hole 68 to the rear side is inserted into the inside of the tube guiding part 75 of the nozzle part 72 before being supported by the base part 63 and then, is guided to the inside of the waste liquid discharging nozzle 73 through the inside of the tube guiding part 75. Thereafter, from a part of the incomplete cylindrical area 77 of the waste liquid discharging nozzle 73 of which the peripheral face is cut away, the downstream end of the flexible tube 43 is extracted to the outside of the waste liquid discharging nozzle 73 at once.

Next, after the flexible tube 43 extracted to the outside of the waste liquid discharging nozzle 73 is loosened to a degree for which the flexible tube 43 can be easily gripped, the downstream end part of the flexible tube 43 is inserted into the inside of the complete cylindrical area 76 of the waste liquid discharging nozzle 73 until the downstream end of the flexible tube 43 reaches the front end of the waste liquid discharging nozzle 73. As a result, the downstream end part of the flexible tube 43 is fitted into the complete cylindrical area 76 so as to be supported by the complete cylindrical area 76.

Then, the flexible tube 43 that is loosened on the outside of the waste liquid discharging nozzle 73 is pulled toward the front side from the tube guiding part 75 so as to remove the loosening. Thereafter, a predetermined part of the flexible tube 43 on the downstream side is pressed to the inner face of the incomplete cylindrical area 77. Accordingly, the predetermined part is fixed by the fixing part 78.

By performing the above-described process, the downstream end part of the flexible tube 43 is supported in an approximate straight line along the axis direction of the waste liquid discharging nozzle 73. In other words, a range of the flexible tube 43 corresponding to a predetermined length from the downstream end is appropriately supported by the waste liquid discharging nozzle 73 and the tube guiding part 75.

Next, in order to support the nozzle part 72 by the base part 63, the tube guiding part 75 of the nozzle part 72 is inserted into the center through hole 68 of the base part 63, and the cylinder part 79 of the nozzle part 72 is inserted into the upper through hole 67 and the lower through hole 69 of the base part 63. Before the cylinder parts 79 are inserted into the upper through hole 67 and the lower through hole 69, the coil springs 80 are installed through the peripheral faces of the cylinder parts 79 in advance.

The cylinder parts 79 are inserted into the upper through hole 67 and the lower through hole 69 until the front end parts of the cylinder parts 79 protrude from the upper through hole 67 and the lower through hole 69 to the front side. At this moment, the coil springs 80 that are installed though the cylinder parts 79 are pinched into the flange parts 70 that are disposed on the front face of the guard part 74 and inside the upper through hole 67 and the lower through hole 69 so as to be slightly contracted. In such a state, while the assembly plate 81 is brought into contact with the front end face of the cylinder part 79 and the screw passing hole 83 of the assembly plate 81 is fitted into the screw hole of the front end face of the cylinder part 79, the assembly plate 81 is stopped and is fixed to the front end face of the cylinder part 79 by a screw 84 (for example, see FIG. 7A). Thereafter, a predetermined position of a part of the flexible tube 43 that is extracted from the assembly plate-side through hole 82 of the assembly plate 81 is fixed by the tube fixing part 71 of the base part 63.

When a series of the above-described processes is completed, assembly of the waste liquid discharging nozzle unit 28 is completed. The assembled waste liquid discharging nozzle unit 28 is fixed to a predetermined fixing position located inside the housing chamber 30 of the housing unit 26. In addition, the waste liquid discharging nozzle unit 28 is fixed in a state in which the axis direction of the waste liquid discharging nozzle 73 is approximately parallel to the longitudinal direction (that is, the installation direction) of the housing unit 26 and the front end of the waste liquid discharging nozzle 73 faces the installation position 31 (see FIG. 3).

In the waste liquid discharging nozzle unit 28 after assembly, the coil spring 80 that is installed though the cylinder part 79 is slightly contracted. On the other hand, the assembly plate 81 that is fixed to the front end face of the cylinder part 79 through which the coil spring 80 is installed is brought into contact with the front face of the rear wall 61 of the base part 63 so as to be locked with the front face. Accordingly, the guard part 74 having the cylinder part 79 through which the coil spring 80 is installed is biased toward the rear side (front side) by the coil spring 80. By the above-described biasing of the coil spring 80, the waste liquid discharging nozzle unit 28 maintains the state shown in FIG. 7A. In other words, in the waste liquid discharging nozzle unit 28 that is fixed to the inside of the housing chamber 30, a state in which the axis direction of the waste liquid discharging nozzle 73 becomes the horizontal direction due to biasing of the coil spring 80 is maintained.

On the other hand, when an external force is applied to the guard part 74 from the rear side toward the front side, the guard part 74 is pressed to the front side by the external force. As a result, as shown in FIG. 7B, the nozzle unit 72 moves to the front side with supporting the flexible tube 43 while contracting the coil spring 80 further together with the assembly plate 81. As described above, the nozzle part 72 is supported by the base part 63 to be movable in the front-rear direction with the posture (that is, the axis direction of the waste liquid discharging nozzle 73) of the waste liquid discharging nozzle 73 maintained.

In addition, in the waste liquid discharging nozzle unit 28 after assembly, the tube guiding part 75 and the cylinder part 79 are inserted into the through holes (that is, the upper through hole 67, the center through hole 68, and the lower through hole 69) so as to have allowance in the diameter direction. Accordingly, when an external force is applied to the waste liquid discharging nozzle 73 in a direction for intersecting the axis direction of the waste liquid discharging nozzle 73, the nozzle part 72 oscillates with a position on the base part 63 side used as a fulcrum point.

In other words, when an external force is applied to the waste liquid discharging nozzle 73 from the lower side toward the upper side, as shown in FIG. 9A, the nozzle part 72 oscillates such that the front end of the waste liquid discharging nozzle 73 is moved to the upper side. On the other hand, when an external force is applied to the waste liquid discharging nozzle 73 from the upper side toward the lower side, as shown in FIG. 9B, the nozzle part 72 oscillates such that the front end of the waste liquid discharging nozzle 73 is moved to the lower side. In addition, when an external force is applied to the waste liquid discharging nozzle 73 in the left-right direction, the nozzle part 72 oscillates such that the front end of the waste liquid discharging nozzle 73 is moved to the left-right side. As described above, in the waste liquid discharging nozzle unit 28, the waste liquid discharging nozzle 73 can oscillate with a position located on the base part 63 side used as a fulcrum point.

In this embodiment, for the waste liquid discharging nozzle 73 to be able to oscillate, the coil spring 80 is installed through the cylinder part 79, and the coil springs 80 are disposed between the front face of the guard part 74 and the flange parts 70 that are disposed in the upper through hole 67 and the lower through hole 69. However, the configuration is not limited thereto. Thus, the coil spring 80 may be configured to be disposed between the guard part 74 and the front wall of the base part 63. Under such a configuration, the cylinder part 79 may not be disposed on the rear face side of the guard part 74. In addition, it may be configured that the waste liquid discharging nozzle 73 does not oscillate with respect to the base part 63, and the axis direction of the waste liquid discharging nozzle 73 is fixed to the horizontal direction.

Structure of Housing Unit 26

Hereinafter, the structure of the housing unit 26 will be described with reference back to FIG. 3.

The housing unit 26, as described above, has the housing chamber 30 therein, and the waste ink tank 27 is installed to the printer main body 11*a* inside the housing chamber 30. In other words, when installed to the printer main body 11*a*, the waste ink tank 27 is placed inside the housing chamber 30 and is pushed up to the installation position 31 located inside the housing chamber 30.

In order to place the waste ink tank 27 inside the housing chamber 30, as shown in FIG. 3, the opening and closing door 36 that is supported to be rotatable about the shaft part 35 disposed on the upper end part is disposed on the front side in the longitudinal direction of the housing unit 26. This opening and closing door 36 can be moved between a closing position denoted by a solid line shown in FIG. 3 and an opening position denoted by a dashed-two dotted line by gripping a clip part 36*a* (see FIG. 2) formed on the surface to be operated for opening or closing with the shaft part 35 used as its center. By opening the opening and closing door 36, an attachment and detachment opening 34 having a rectangular shape that is used for passing the waste ink tank 27 at a time when the waste ink tank 27 is attached to or detached from the installation position 31 is formed.

In addition, on the rear face of the opening and closing door 36, as shown in FIG. 3, the locking protrusion 45 for engaging the lead-out part 53 of the waste ink tank 27 in a state in which the waste ink tank 27 is set in the installation position 31 protrudes. The locking protrusion 45 is engaged with the lead-out part 53 so as to lock the lead-out part 53 in the upper-lower direction, and whereby the lead-out part 53 exhibits a function for suppressing lift of the rear end part of the waste ink tank 27. In addition, the locking protrusion 45 is disposed in a position located on the rear face of the opening and closing door 36 in which the locking protrusion 45 can be engaged with the lead-out part 53 at a time when the opening and closing door 36 is closed in a state in which the waste ink tank 27 is set in the installation position 31.

The bottom wall 32 of the housing unit 26 forms the floor face of the housing chamber 30 on the upper surface and becomes a face for placing the waste ink tank 27 at a time when the waste ink tank 27 is set in the installation position 31. In addition, when the waste ink tank 27 is to be attached to or detached from the printer main body 11*a*, the waste ink tank 27 moves above the bottom wall 32. On the upper surface of the bottom wall 32, as shown in FIG. 3, a front face 37, an intermediate face 38, and a back face 39 are sequentially formed from the front side in the longitudinal direction of the housing unit 26 toward the inner side so as to form level differences. Here, all the front face 37, the intermediate face 38, and the back face 39 are horizontal faces.

The front face 37 is a face formed at a same height as that of the lower edge part of the attachment and detachment opening 34. Between the back side end of the front face 37 and the front side end of the intermediate face 38, as shown in FIG. 3, the locking stair portion 40 for leveling the intermediate face 38 lower than the front face 37 is formed to extend from the left ends of the front face 37 and the intermediate face 38 to the right ends thereof. The locking stair portion 40 is engaged with the stair part 60 of the waste ink tank 27 so as to lock the stair part 60 in a state in which the waste ink tank 27 is set in the installation position 31, and whereby the stair part 60 exhibits the function for determining the position of the waste ink tank 27 in the horizontal direction with respect to the printer main body 11*a*. In addition, the member to be engaged with the stair part 60 for allowing the stair part 60 to exhibit the function for position determining is not limited to the locking stair portion 40. Thus, for example, the above-described member may be a locking convex part that protrudes from the bottom wall 32 of the housing unit 26.

The intermediate face 38 is a face that is formed to be slightly smaller in the direction of the longitudinal direction of the housing unit 26 than the length of the waste ink tank 27 in the front-rear direction. As shown in FIG. 3, the waste ink tank 27 that is set in the installation position 31 is placed in an area that is an approximate half of the back side of the intermediate face 38 and the front face 37. In other words, in a position in which an area that is approximately half of the back side of the intermediate face 38 and the front face 37 is located in the longitudinal direction of the housing unit 26, the installation position 31 of the waste ink tank 27 is located. The back face 39 is a face formed to be lower than the intermediate face 38 through the level difference portion 41 and is fixed due to screw stop of the base part 63 of the waste liquid discharging nozzle unit 28 on the back face 39.

In addition, in the state in which the waste ink tank 27 is set in the installation position 31, heights of the front face 37, the intermediate face 38, and the back face 39 are set such that the center axis of the waste liquid discharging nozzle 73 and the center axis of the insertion hole 57 of the waste ink tank 27 are the same. In addition, the height (a distance between the bottom wall 32 and the upper wall 33) of the inside of the housing chamber 30 is set to be sufficiently larger than the height of the waste ink tank 27, so that the posture of the waste ink tank 27 can be tilted at a time when the waste ink tank 27 is pushed (or extracted from the installation position 31) toward the installation position 31 (see FIG. 3 and FIG. 10B). The attachment and detachment of the waste ink tank 27 will be described in detail in the next section.

Attachment and Detachment of Waste Ink Tank 27

Next, the sequence of attaching and detaching the waste ink tank 27 with respect to the printer main body 11*a* will be described with reference to FIGS. 10A to 10H.

FIGS. 10A to 10H are explanatory diagrams for the sequence of installing the waste ink tank 27 to the printer main body 11*a*. In the diagrams, the upper and lower directions of the printer 11 and the installation direction of the waste ink tank 27 are denoted by arrows. In addition, in the diagrams, each member is shown in the cross-section view. However, only a part of the waste liquid discharging nozzle unit 28 is shown in the cross-section view. In addition, the installed state of the waste ink tank 27 is sequentially transited from the state shown in FIG. 10A to the state shown the FIG. 10H.

When the waste ink tank 27 is to be installed to the printer main body 11*a*, the waste ink tank 27 is placed inside the housing chamber 30 and is pushed up to an installation position 31, which is located inside the housing chamber 30, in the longitudinal direction of the housing unit 26, that is, the installation direction. Accordingly, first, as shown in FIG. 10A, the opening and closing door 36 of the housing unit 26 is opened so as to form the attachment and detachment opening 34, and the waste ink tank 27 is placed inside the housing chamber 30 through the attachment and detachment opening 34.

At this moment, in a step for placing the waste ink tank 27 inside the housing chamber 30, the waste liquid discharging nozzle unit 28 is already fixed to the bottom wall 32 (in particular, on the back face 39 of the bottom wall 32) of the housing unit 26. In addition, the axis direction of the waste liquid discharging nozzle 73 is in correspondence with the horizontal direction. Naturally, the waste ink tank 27 is placed inside the housing chamber 30 from the front end in which the insertion hole 57 is formed in the front-rear direction. Accordingly, the front end part of the waste ink tank 27 corresponds to the front end part in the installation direction (similarly, the rear end part of the waste ink tank 27 corresponds to the rear end part in the installation direction).

Figure 10A:
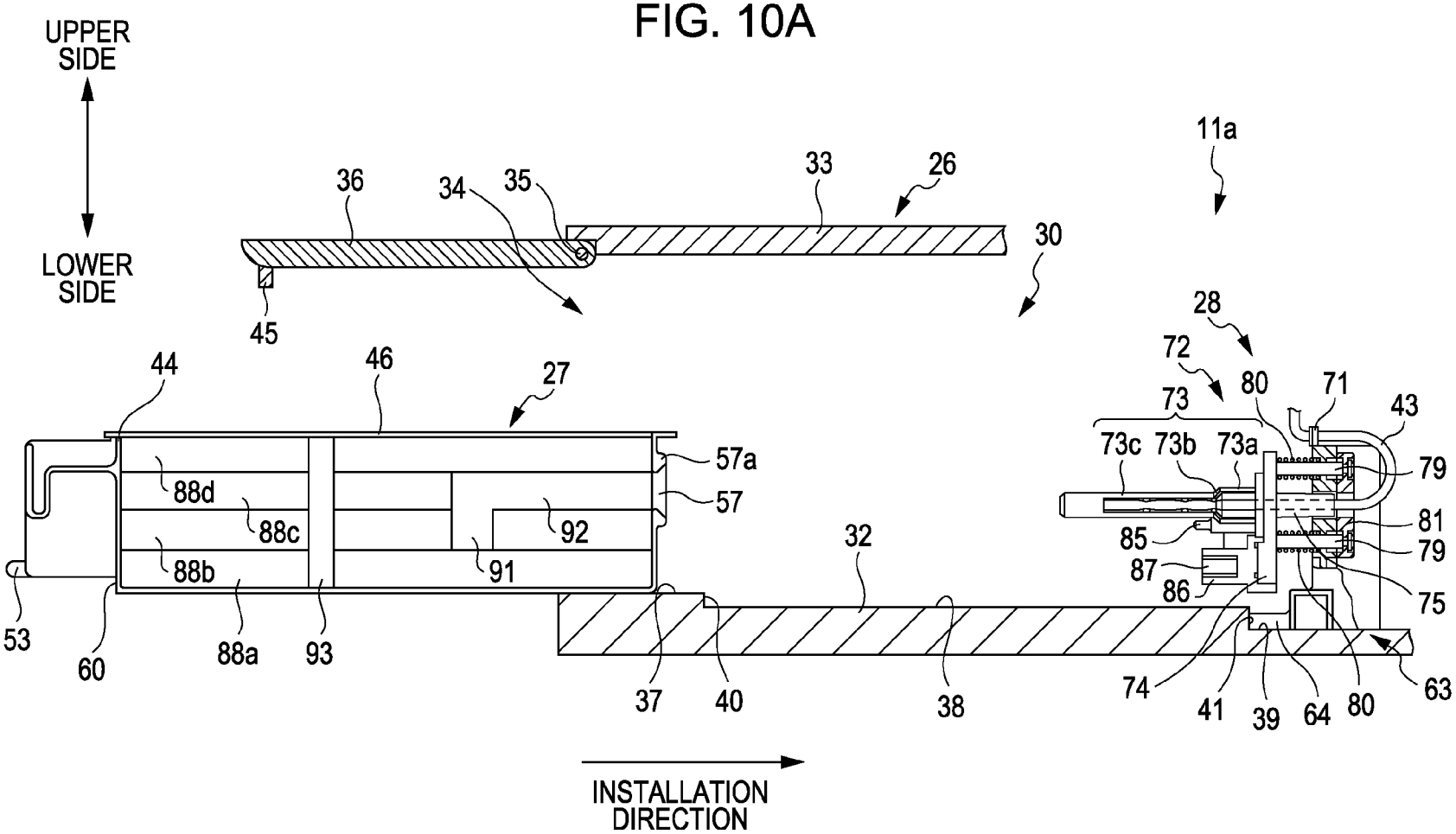
FIG. 10A is a first explanatory diagram for the sequence of installing the waste ink tank 27 to a printer main body 11*a* according to an embodiment of the invention.
Figure 10B:
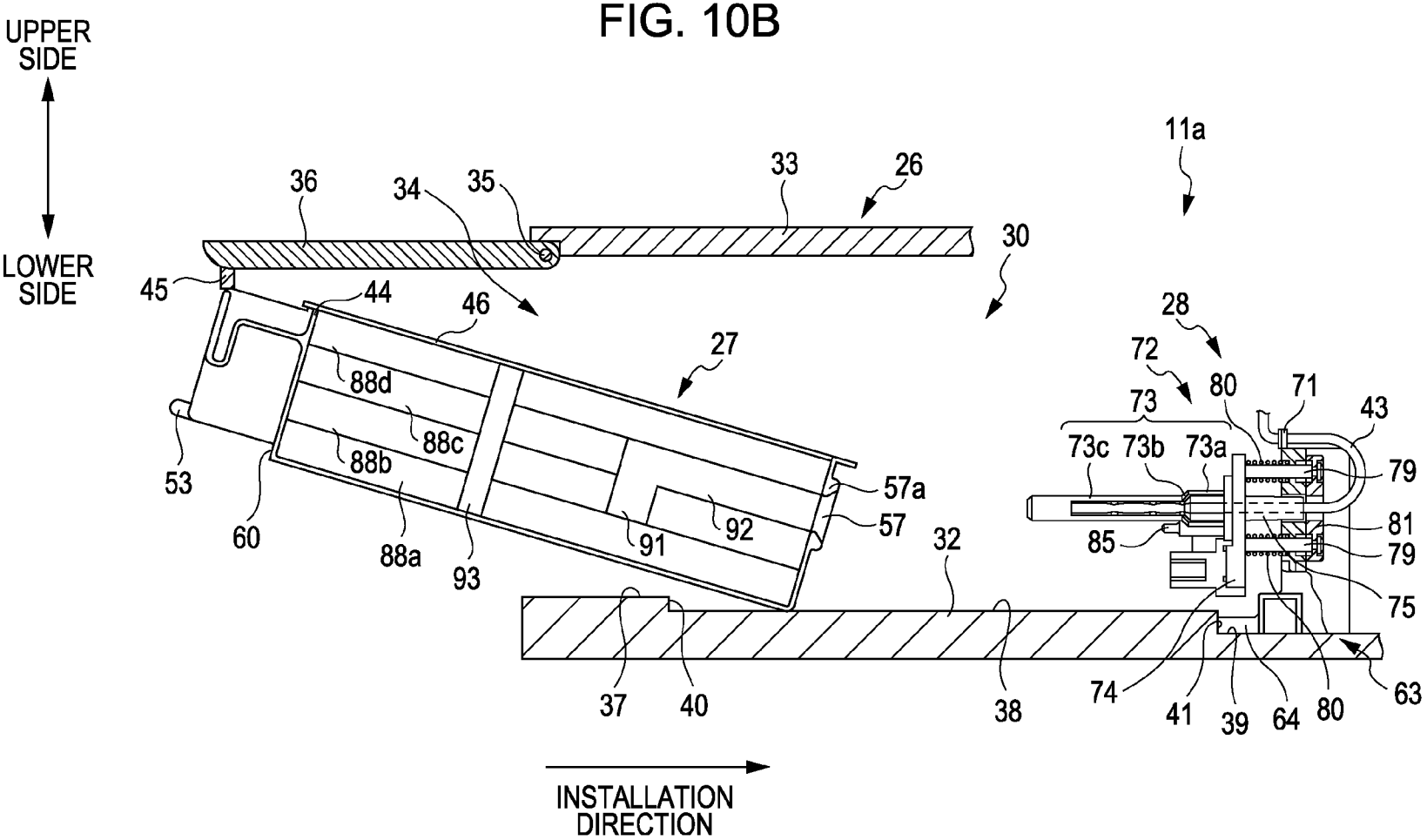
FIG. 10B is a second explanatory diagram for the sequence of installing the waste ink tank 27 to the printer main body 11*a*.

After the front end of the waste ink tank 27 passes through the attachment and detachment opening 34, for a short while, the waste ink tank 27, as shown in FIG. 10A, is pushed such that the bottom face of the waste ink tank 27 is slid on the front face 37 while the posture of the waste ink tank 27 is maintained to be horizontal. In other words, in an initial stage of the installation of the waste ink tank 27, the waste ink tank 27 is moved with the posture in a horizontal state. Then, when the waste ink tank 27 is pushed to be slid on the front face 37, as shown in FIG. 10A, the center axis of the insertion hole 57 of the waste ink tank 27 is located on the upper side in the upper-lower direction relative to the center axis of the waste liquid discharging nozzle 73. Then, after the waste ink tank 27 is pushed to some degree with the horizontal posture maintained, as shown in FIG. 10B, the posture of the waste ink tank 27 is tilted with respect to the installation direction, that is, the horizontal direction by a user.

Described in more details, after the front end of the waste ink tank 27 passes though the locking stair portion 40, the user grips the rear end part of the waste ink tank 27 so as to lift the rear end part to the upper side. Accordingly, the waste ink tank 27 is tilted such that the front end part of the waste ink tank 27 is located on the lower side in the upper-lower direction relative to the rear end part. Thereafter, for a short while, the waste ink tank 27 is pushed in the installation direction while maintained by the user to be in the tilted state with respect to the installation direction (horizontal direction) (installed to the printer main body 11*a*). In addition, the tilt angle of the waste ink tank 27 with respect to the installation direction, for example, is adjusted to an angle for which the upper part of the front end of the small diameter portion 73*c* of the waste liquid discharging nozzle 73 is brought into contact with the upper part of the inner face of the insertion hole 57 at a time when the waste ink tank 27 is pushed in the installation direction so as to maintain the tilt angle. In addition, when the waste ink tank 27 is pushed in the tilted state as described above, as shown in FIG. 10B, the front end of the bottom face of the waste ink tank 27 slides on the intermediate face 38 of the bottom wall 32 of the housing unit 26.

Figure 10C:
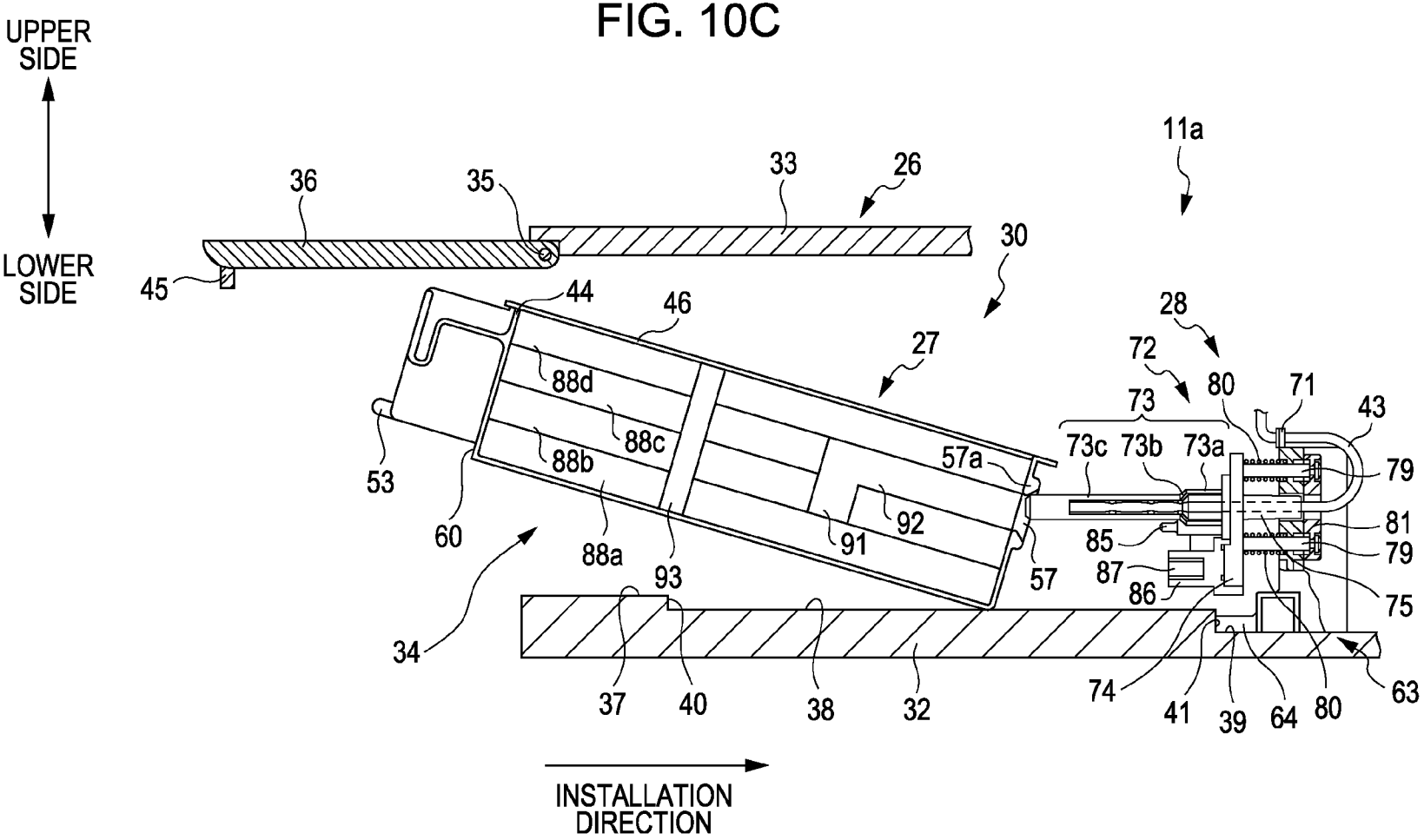
FIG. 10C is a third explanatory diagram for the sequence of installing the waste ink tank 27 to the printer main body 11*a*.

When the waste ink tank 27 is pushed to the back side further, the waste ink tank 27, as shown in FIG. 10C, finally reaches the position in which the upper part (that is, the upper part of the front end of the small diameter portion 73*c*) of the front end of the waste liquid discharging nozzle 73 in the installation direction is brought into contact with the upper part of the inner face of the insertion hole 57. Here, as described above, according to this embodiment, a configuration in which the waste liquid discharging nozzle 73 can oscillate with the position located on the base part 63 side used as a fulcrum point is implemented. In addition, the insertion hole 57 is formed to have the aperture gradually decreasing toward the inner part from the opening edge 57*a*. Under the above-described configuration, when the waste ink tank 27 located in the position in which the upper part of the front end of the waste liquid discharging nozzle 73 is brought into contact with the upper part of the inner face of the insertion hole 57 is pushed to the back side further, the waste ink tank 27 is moved in the installation direction with being brought into contact with the upper part of the front end of the waste liquid discharging nozzle 73 in the upper part of the inner face of the insertion hole 57. Accordingly, the front end of the waste liquid discharging nozzle 73 is led to the inner center of the insertion hole 57. As a result, even for a case where the waste ink tank 27 is installed to the printer main body 11*a* with being tilted with respect to the installation direction, the waste liquid discharging nozzle 73 is inserted into the insertion hole 57 in a smooth manner.

Described in more details, when the waste ink tank 27 is pushed in the installation direction in a state in which the upper part of the inner face of the insertion hole 57 is brought into contact with the upper part of the front end of the waste liquid discharging nozzle 73, the upper part of the inner face of the insertion hole 57 slides on the upper part of the front end of the waste liquid discharging nozzle 73 while pushing the front end of the waste liquid discharging nozzle 73 to the lower side in resistance against a biasing force of the coil springs 80. In other words, the inner face of the insertion hole 57 is tilted with respect to the installation direction. Thus, when the waste ink tank 27 is pushed in a state in which the upper part of the front end of the waste liquid discharging nozzle 73 is brought into contact with the upper part of the inner face of the insertion hole 57, the waste ink tank 27 applies a force toward the lower side to the waste liquid discharging nozzle 73 through the upper part of the inner face of the insertion hole 57. On the other hand, a biasing force for maintaining the axis direction of the waste liquid discharging nozzle 73 to be a horizontal direction is applied to the waste liquid discharging nozzle 73 all the time by the coil springs 80. The force toward the lower side which is applied from the waste ink tank 27 is stronger than the biasing force of the coil springs 80, and accordingly, the nozzle part 72 oscillates such that the front end of the waste liquid discharging nozzle 73 is moved to the lower side. Even while the front end of the waste liquid discharging nozzle 73 is moved to the lower side by the biasing force of the coil springs 80, the waste ink tank 27 is continuously brought into contact with the upper part of the front end of the waste liquid discharging nozzle 73 in the upper part of the inner face of the insertion hole 57. In such a state, when the waste ink tank 27 is pushed further, the waste ink tank 27 is moved from the opening edge 57*a* toward the inner part. Accordingly, the waste ink tank 27 pushes the front end of the waste liquid discharging nozzle 73 to the lower side further in the upper part of the inner face of the insertion hole 57 of which the aperture is gradually decreased, and thereby the state for contacting the upper part of the front end of the waste liquid discharging nozzle 73 is maintained.

As a result, while the front end of the waste liquid discharging nozzle 73 passes through the inside of the insertion hole 57, the waste ink tank 27 is continuously brought into contact with the upper part of the front end of the waste liquid discharging nozzle 73 in the upper part of the inner face of the insertion hole 57. Accordingly, the upper part of the inner face of the insertion hole 57 slides on the upper part of the front end of the waste liquid discharging nozzle 73. In other words, the front end of the waste liquid discharging nozzle 73 is led to the inner center of the insertion hole 57. Accordingly, the waste liquid discharging nozzle 73 is inserted into the insertion hole 57 in a smooth manner.

Figure 10D:
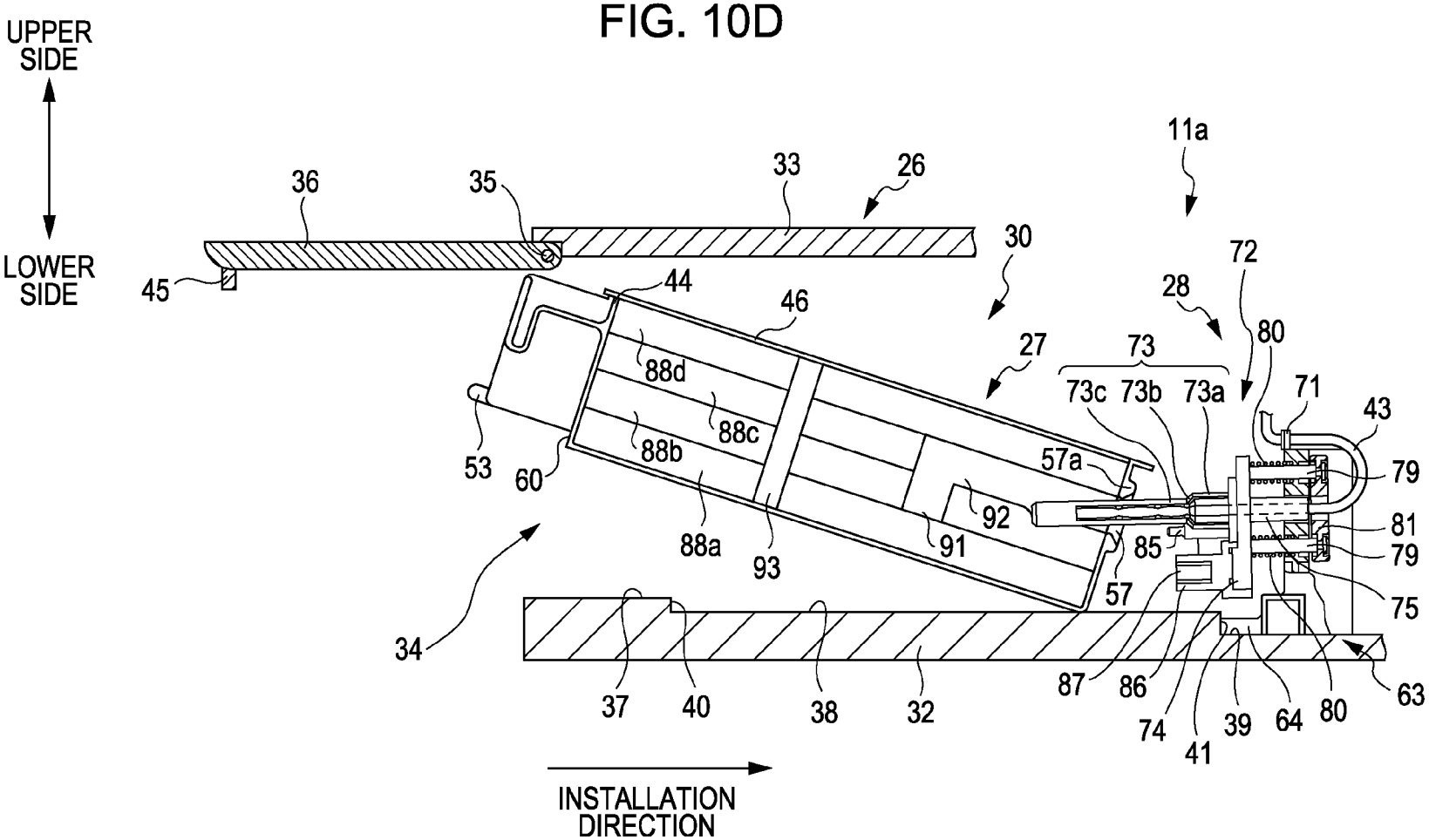
FIG. 10D is a fourth explanatory diagram for the sequence of installing the waste ink tank 27 to the printer main body 11*a*.

When the waste ink tank 27 is pushed further to the back side in the installation direction after the upper part of the front end of the waste liquid discharging nozzle 73 is brought into contact with the upper part of the inner face of the insertion hole 57, as described above, the front end of the small diameter portion 73*c* is led to the inner center of the insertion hole 57. Accordingly, the waste liquid discharging nozzle 73 is inserted into the insertion hole 57. Thereafter, a part (hereinafter, referred to as a same diameter portion), which has the same diameter, of the small diameter portion 73*c* of the waste liquid discharging nozzle 73 approaches the inside of the insertion hole 57. At this moment, as shown in FIG. 10D, the upper part of the inner face of the insertion hole 57 slides on the upper part of the outer circumferential face of the same diameter portion.

Described in more details, after the front end of the small diameter portion 73*c* of the waste liquid discharging nozzle 73 is led to the inner center of the insertion hole 57, the same diameter portion of the small diameter portion 73*c* passes through the inside of the insertion hole 57 in a state in which the front end (that is, the front end of the waste liquid discharging nozzle 73) of the small diameter portion 73*c* is pressed to the lower side. To the small diameter portion 73*c* of the waste liquid discharging nozzle 73, a biasing force is applied by the coil springs 80, so that the axis direction of the waste liquid discharging nozzle 73 returns to the horizontal direction. In other words, while the same diameter portion of the small diameter portion 73*c* of the waste liquid discharging nozzle 73 passes through the inside of the insertion hole 57, the same diameter portion is biased by the coil springs 80 such that the upper part of the outer circumferential face of the same diameter portion faces the upper part of the inner face of the insertion hole 57. Accordingly, the small diameter portion 73*c* of the waste liquid discharging nozzle 73 is continuously brought into contact with the upper part of the inner face of the insertion hole 57 in the upper part of the outer circumferential face of the same diameter portion of the small diameter portion 73*c* in a state in which the front end of the small diameter portion 73*c* is pressed to the lower side.

Figure 10E:
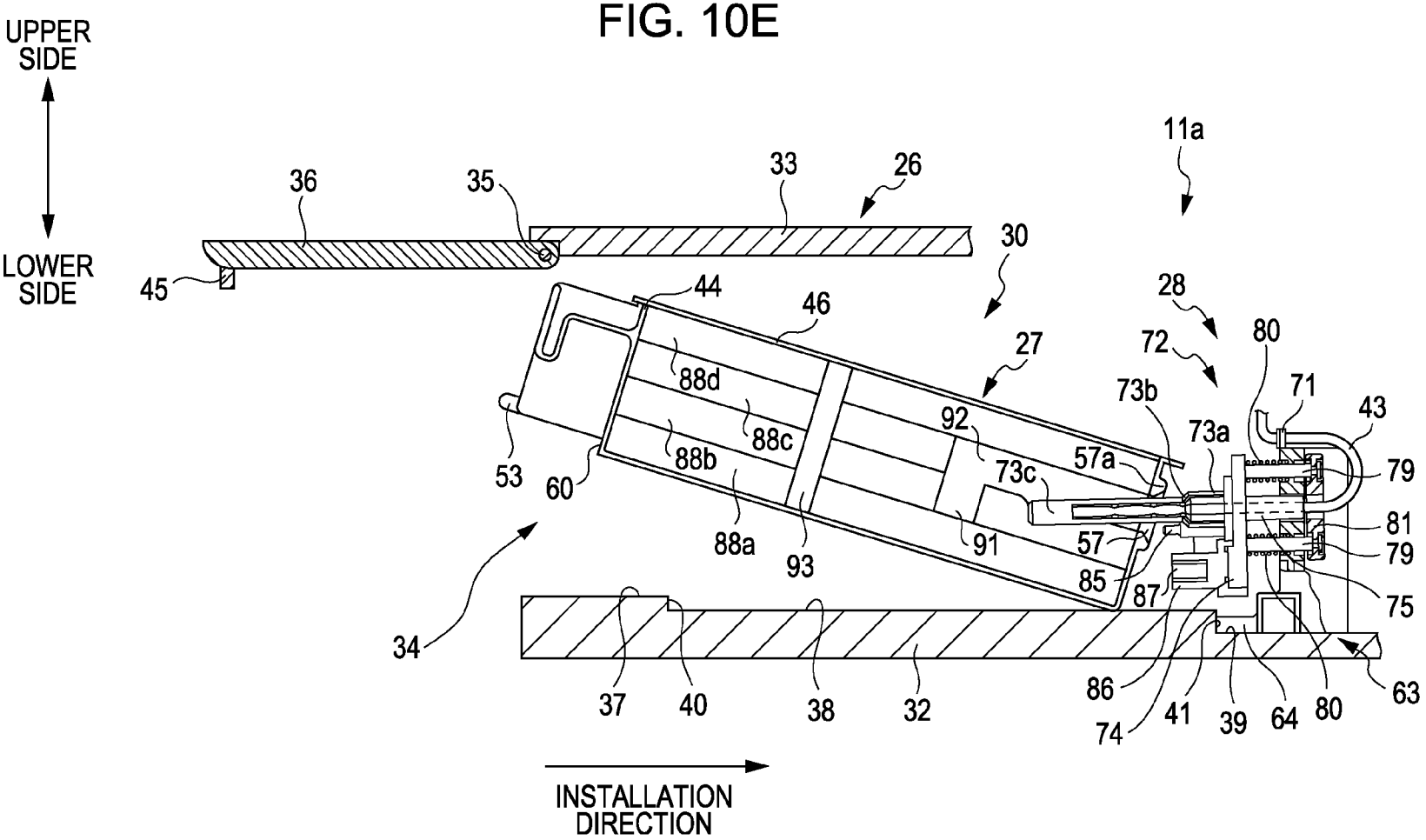
FIG. 10E is a fifth explanatory diagram for the sequence of installing the waste ink tank 27 to the printer main body 11*a*.

When the above-described situation is described again from the waste ink tank 27 side, the waste ink tank 27 is continuously brought into contact with the upper part of the outer circumferential face of the small diameter portion 73*c* that is biased by the coil springs 80 in the upper part of the inner face of the insertion hole 57 as described above during a period in which the same diameter portion of the small diameter portion 73*c* passes through the inside of the insertion hole 57. As a result, the waste ink tank 27, as shown in FIGS. 10C to 10E, is moved in the installation direction, so that the upper part of the inner face of the insertion hole 57 slides on the upper part of the outer circumferential face of the same diameter portion of the small diameter portion 73*c*.

As described above, according to this embodiment, when the waste ink tank 27 is installed to the printer main body 11*a*, the waste ink tank 27 is continuously brought into contact with the upper part of the outer circumferential face of the small diameter portion 73*c*, which is biased by the coil springs 80, in the upper part of the inner face of the insertion hole 57 during a period in which the small diameter portion 73*c* of the waste liquid discharging nozzle 73 passes through the inside of the insertion hole 57. Then, by pushing the waste ink tank 27 in the installation direction in a state in which the contact between the upper part of the inner face of the insertion hole 57 and the upper part of the outer circumferential face of the small diameter portion 73*c* is maintained, the waste ink tank 27 is pushed toward the installation position 31 appropriately. In other words, the waste ink tank 27 is brought into contact with the upper part of the outer circumferential face of the small diameter portion 73*c* in the upper part of the inner face of the insertion hole 57, and whereby the waste ink tank 27 guides the small diameter portion 73*c* toward the position of the small diameter portion 73*c* at a time when the insertion hole 57 is fitted to the large diameter portion 73*a* of the waste liquid discharging nozzle 73. In addition, according to this embodiment, while the small diameter portion 73*c* passes through the inside of the insertion hole 57, the contact state between the upper part of the inner face of the insertion hole 57 and the upper part of the outer circumferential face of the small diameter portion 73*c* is continued. Accordingly, the small diameter portion 73*c* is continuously guided to the above-described position by the waste ink tank 27 (in particular, the upper part of the inner face of the insertion hole 57) while passing through the inside of the insertion hole 57.

In addition, while the same diameter portion of the small diameter portion 73*c* of the waste liquid discharging nozzle 73 passes through the inside of the insertion hole 57, the front end of the waste liquid discharging nozzle 73 is tilted to be located on the lower side relative to the original position. Accordingly, as shown in FIG. 10D, the ink absorber 88*b* located second from the lower side is pressed to the lower side by the small diameter portion 73*c*.

Figure 10F:
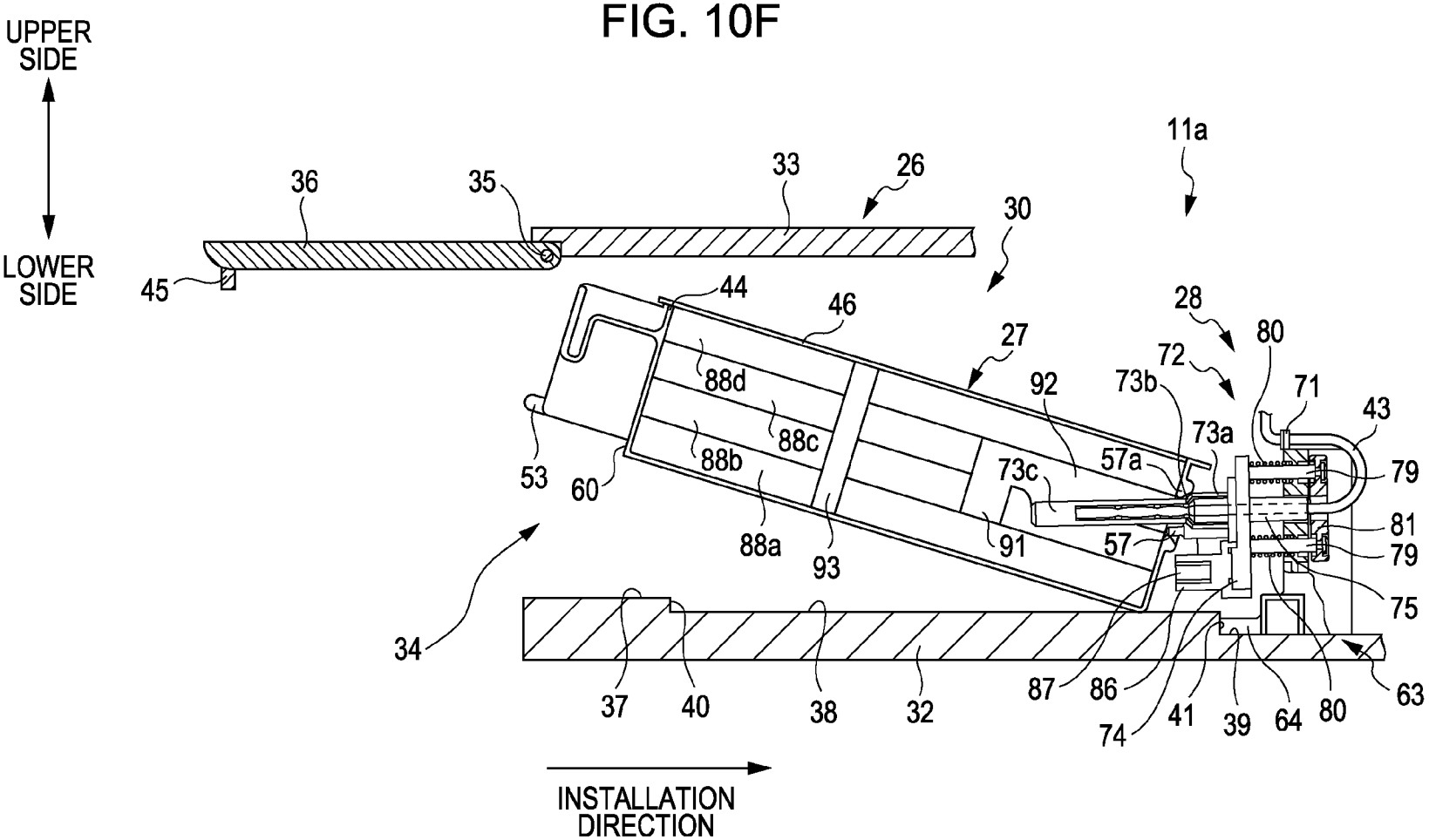
FIG. 10F is a sixth explanatory diagram for the sequence of installing the waste ink tank 27 to the printer main body 11*a*.

Then, when the waste ink tank 27 is pushed further to the back side, the waste ink tank 27 finally reaches the position in which the upper part of the inner face of the insertion hole 57 is brought into contact with the outer circumferential face of the taper part 73*b*. When the waste ink tank 27 is pushed further to the back side from the position, as shown in FIG. 10F, the upper part of the inner face of the insertion hole 57 slides on the upper part of the outer circumferential face of the taper part 73*b*. The reason is that the taper part 73*b* is biased by the coil springs 80 such that the upper part of the outer circumferential face of the taper part 73*b* faces the inner face of the insertion hole 57 during a period in which the taper part 73*b* passes though the inside of the insertion hole 57. Then, when the waste ink tank 27 is pushed further, so that the upper part of the inner face of the insertion hole 57 slides on the upper part of the outer circumferential face of the taper part 73*b*, the waste ink tank 27 reaches a position in which the upper part of the inner face of the insertion hole 57 is brought into contact with the upper part of the outer circumferential face of the large diameter portion 73*a*. In addition, as shown in FIG. 10F, even while the upper part of the inner face of the insertion hole 57 slides on the upper part of the outer circumferential face of the taper part 73*b*, the ink absorber 88*b* located second from the lower side is in a state of being pressed to the lower side by the small diameter portion 73*c* of the waste liquid discharging nozzle 73.

Figure 10G:
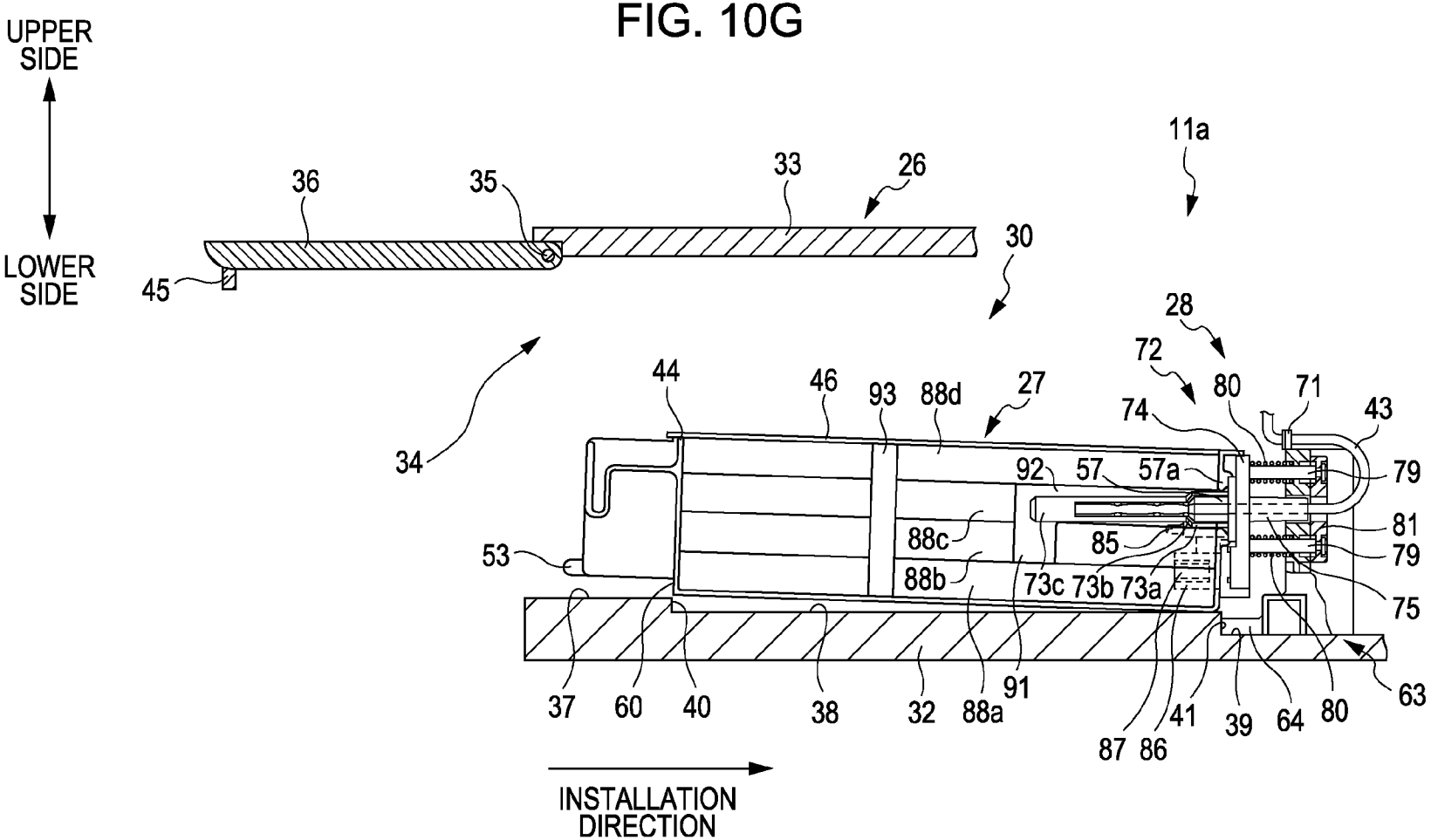
FIG. 10G is a seventh explanatory diagram for the sequence of installing the waste ink tank 27 to the printer main body 11*a*.

After the waste ink tank 27 reaches the position in which the upper part of the inner face of the insertion hole 57 is brought into contact with the upper part of the outer circumferential face of the large diameter portion 73*a*, the user pushes the waste ink tank 27 further to the back side in the installation direction until the opening edge part 57*a* of the insertion hole 57 is brought into contact with the guard part 74 of the nozzle part 72 while lowering the rear end part of the waste ink tank 27. Accordingly, as shown in FIG. 10G, the waste ink tank 27 slowly returns to the horizontal posture. Then, at a time point when the posture of the waste ink tank 27 becomes the horizontal posture, the waste liquid discharging nozzle 73 is opened by the pressure applied by the waste ink tank 27 (in particular, the upper part of the inner face of the insertion hole 57) and is biased by the coil springs 80. Accordingly, the axis direction of the waste liquid discharging nozzle 73 returns to the horizontal direction. In accordance with the above-described operation, the ink absorber 88*b* located second from the lower side is returned from a state pressed by the small diameter portion 73*c* of the waste liquid discharging nozzle 73 to a state before being pressed.

Then, at a time point when the posture of the waste ink tank 27 becomes the horizontal posture, the center axis of the insertion hole 57 and the center axis of the waste liquid discharging nozzle 73 become the same, and accordingly, the front end of the waste liquid discharging nozzle 73 is located inside the square-shaped hole 91 that is formed in the ink absorber 88*b* located second from the lower side. At this moment, the insertion hole 57 is fitted with the large diameter portion 73*a* of the waste liquid discharging nozzle 73. As a result, the insertion hole 57 determines the position of the waste ink tank 27 in the diameter direction of the large diameter portion 73*a* with respect to the printer main body 11*a*.

In addition, while the waste ink tank 27 is pushed further with the waste ink tank 27 returning to the horizontal posture, the position adjusting pin 85 that protrudes from the guard part 74 is inserted into the position adjusting hole 58*a* of the tube part 58 of the waste ink tank 27. Accordingly, the position adjusting hole 58*a* serves to suppress rotation of the waste ink tank 27. After the position adjusting pin 85 is inserted into the position adjusting hole 58*a*, the memory element 59 that is disposed on the sub right wall 50*b* of the waste ink tank 27 is brought into contact with the contact point 87 that is disposed on the left face of the vertical plate part 86 of the guard part 74.

In addition, while the waste ink tank 27 is pushed further with the waste ink tank 27 returning to the horizontal posture, the opening edge 57*a* of the insertion hole 57 of the waste ink tank 27 is brought into contact with the guard part 74 of the nozzle part 72. Accordingly, the nozzle part 72 is pushed to the back side in the installation direction together with the waste ink tank 27. Accordingly, the nozzle part 72 moves to the back side in the installation direction while contracting the coil springs 80 further. Thereafter, the posture of the waste ink tank 27 is returned to the horizontal posture in a state in which the coil springs 80 are more contracted than the original state (a state before the waste ink tank 27 is installed to the printer main body 11*a*), and accordingly, the waste ink tank 27 is placed on the bottom wall 32 of the housing unit 26. At this moment, as shown in FIG. 10G, the end part 60 of the container unit 44 of the waste ink tank 27 is located in a position (that is, a position located on the back side relative to the locking stair portion 40) in which the locking stair portion 40 that is formed inside the housing chamber 30 is passed in the installation direction. Accordingly, right after the posture of the waste ink tank 27 is returned to the horizontal posture, the waste ink tank 27 is in a state in which the installation position 31 located inside the housing chamber 30 in the installation direction is passed.

Figure 10H:
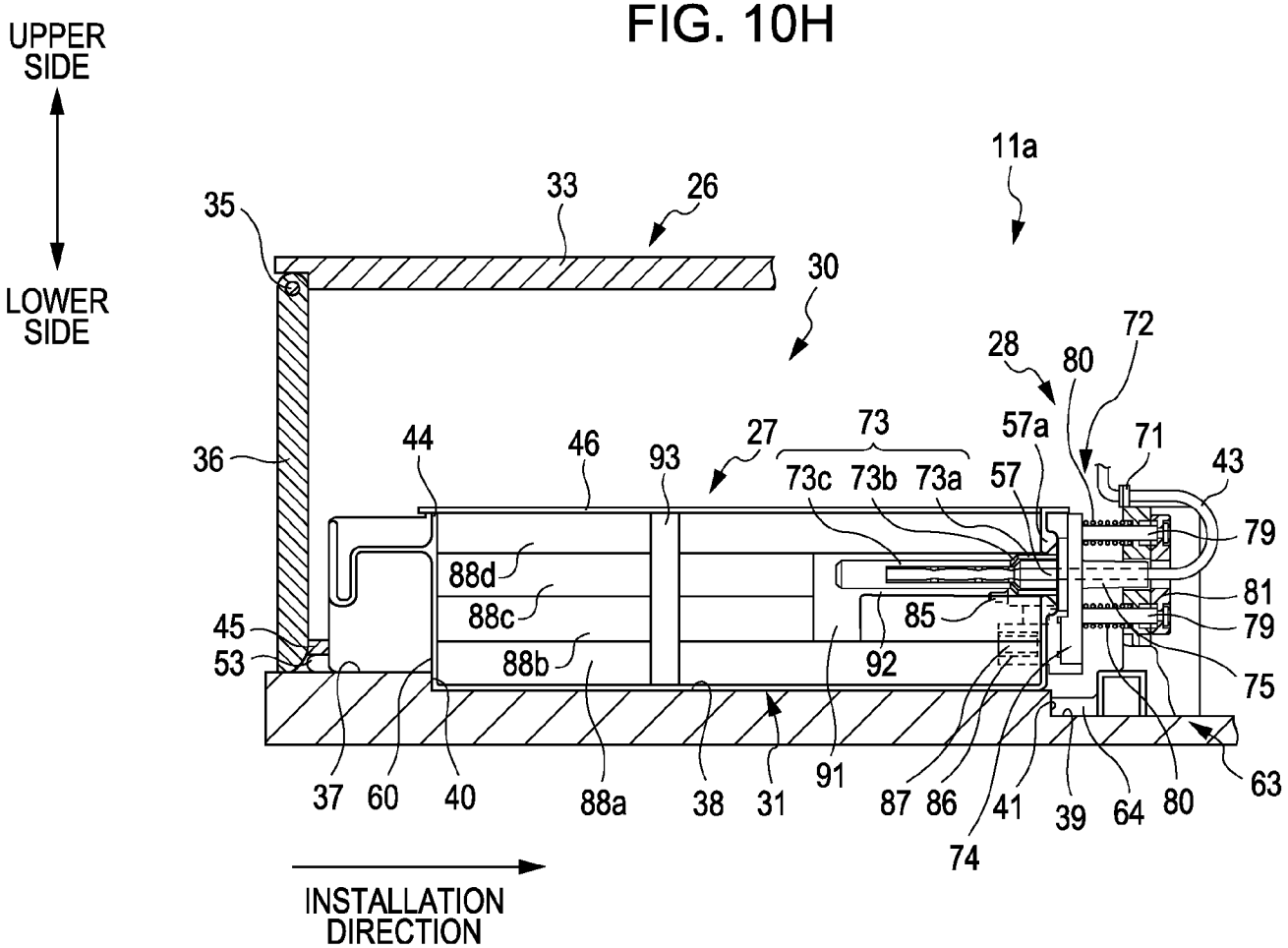
FIG. 10H is an eighth explanatory diagram for the sequence of installing the waste ink tank 27 to the printer main body 11*a*.

Then, when the user releases his grip from the waste ink tank 27 (releases the state in which the waste ink tank 27 is held) after returning the waste ink tank 27 to the horizontal posture, the coil springs 80 return to the original state from the contracted state. Accordingly, the nozzle part 72 is pushed back to the front side in the installation direction by the coil springs 80. In accordance with the above-described operation, the waste ink tank 27 in the state in which the opening edge 57*a* of the insertion hole 57 is brought into contact with the guard part 74 of the nozzle part 72 also slides on the bottom wall 32 of the housing unit 26 to the front side in the installation direction. As a result, as shown in FIG. 10H, the stair part 60 of the container unit 44 is engaged with the locking stair portion 40 of the bottom wall 32 of the housing unit 26. Accordingly, the stair part 60 exhibits the function for determining the position of the waste ink tank 27 in the horizontal direction with respect to the printer main body 11*a*. Described in more details, movement of the waste ink tank 27 in the take-out direction (a direction opposite to the installation direction) is regulated.

As described above, in the waste ink tank 27, the opening edge 57*a* of the insertion hole 57 is brought into contact with the guard part 74 of the nozzle part 72 on the back side in the installation direction, and the stair part 60 of the container unit 44 is engaged with the locking stair portion 40 of the bottom wall 32 of the housing unit 26 on the front side. As a result, the positions of the front end and the rear end of the waste ink tank 27 in the horizontal direction are determined. Then, the position in which the front end and the rear end of the waste ink tank 27 are positioned in the horizontal direction becomes the installation position 31.

Then, when the opening and closing door 36 is closed in the state in which the waste ink tank 27 is positioned (set) in the installation position 31, as shown in FIG. 10H, the locking protrusion 45 that is disposed to protrude on the rear face of the opening and closing door 36 is engaged with the lead-out part 53 that is pulled out from the lower end of the rear wall 52 of the container unit 44. Accordingly, the lead-out part 53 exhibits a function for suppressing lift of the rear end part of the waste ink tank 27 to the upper side due to an external force (for example, a force toward the upper side generated due to the biasing force of the coil springs 80) or the like.

At a time point when the above-described sequence is completed, the installation of the waste ink tank 27 is completed. When the installation of the waste ink tank 27 is completed (that is, when the waste ink tank 27 is set in the installation position 31), the front-end opening of the waste liquid discharging nozzle 73 is positioned inside the square-shaped hole 91 that is formed in the ink absorber 88*c* located third from the lower side inside the waste ink tank 27. Accordingly, a flow path of the waste ink between the insertion hole 57 and the square-shaped hole 91 is formed. In other words, a state in which the waste ink tank 27 can store waste ink discharged from the front-end opening of the waste liquid discharging nozzle 73 inside the square-shaped hole 91 is formed.

On the other hand, when the waste ink tank 27 set in the installation position 31 is detached from the printer 11, the opening and closing door 36 is opened again so as to open the attachment and detachment opening 34, and the user puts his hand inside the attachment and detachment opening 34 so as to grip the rear end part of the waste ink tank 27. Then, the user lifts the rear end part of the waste ink tank 27 to the upper side so as to tilt the posture of the waste ink tank 27 and then, takes out the waste ink tank 27 such that the engaged state between the locking stair portion 40 and the stair part 60 is released. At this moment, to the waste ink tank 27, the biasing force (a biasing force toward the front side) of the coil springs 80 is applied through the nozzle part 72. Since this biasing force acts in the direction for taking out the waste ink tank 27, the biasing force becomes an auxiliary force for taking out the waste ink tank 27. Accordingly, the waste ink tank 27 can be taken out from the attachment and detachment opening 34 in an easy manner.

In addition, since the waste ink tank 27 is taken out with the posture of the waste ink tank 27 tilted as described above, the waste ink tank 27 is moved in the take-out direction (a direction opposite to the installation direction) with the ink absorber 88*b* located second from the lower side pressed by the small diameter portion 73*c* of the waste liquid discharging nozzle 73 (see FIGS. 10F, 10E, and 10D). In other words, when the waste ink tank 27 is taken out in the take-out direction in the tilted state, the small diameter portion 73*c* of the waste liquid discharging nozzle 73 is rubbed with the ink absorber 88*b* located second from the lower side. Accordingly, the waste ink adhering to the front end part of the waste liquid discharging nozzle 73 is wiped out by the ink absorber 88*b* located second from the lower side. As a result, contamination of the periphery due to the waste ink adhering to the front end part of the waste liquid discharging nozzle 73 at a time when the waste ink tank 27 is taken outside (that is, the outside of the housing unit 26) the housing chamber 30 can be prevented.

Effectiveness of Waste Ink Tank 27 According to this Embodiment

As described above, the waste ink tank 27 according to this embodiment can be installed to the printer main body 11*a*. The waste ink tank 27 includes the insertion hole 57 into which the waste liquid discharging nozzle 73, which can be included in the main part 11*a* of the printer, having the large diameter portion 73*a* and the small diameter portion 73*c* located on the front end side relative to the large diameter portion 73*a* can be inserted. The insertion hole 57 guides the small diameter portion 73*c* by being brought into contact with the outer circumferential face of the small diameter portion 73*c* on the inner face of the insertion hole 57 at a time when the waste ink tank 27 is installed to the printer main body 11*a*. In addition, the insertion hole 57 determines the position of the waste ink tank 27 in the diameter direction of the large diameter portion 73*a* with respect to the printer main body 11*a* by being fitted with the large diameter portion 73*a*. The waste ink tank 27 having such a configuration can be installed to the printer main body 11*a* in an easy manner.

Effectiveness of Printer 11 According to this Embodiment

As described above, the printer 11 according to this embodiment includes the printer main body 11*a* that has the waste liquid discharging nozzle 73 for discharging waste ink, the insertion hole 57 into which the waste liquid discharging nozzle 73 can be inserted, and the waste ink tank 27 that is installed to the printer main body 11*a*. In addition, the waste liquid discharging nozzle 73 includes the large diameter portion 73*a* and the small diameter portion 73*c* that is located on the front end side relative to the large diameter portion 73*a*. When the waste ink tank 27 is installed to the printer main body 11*a*, the waste ink tank 27 guides the small diameter portion 73*c* by being brought into contact with the upper part of the outer circumferential face of the small diameter portion 73*c* in the upper part of the inner face of the insertion hole 57 during a period in which the small diameter portion 73*c* passes through the inside the insertion hole 57. In addition, the insertion hole 57 determines the position of the waste ink tank 27 in the diameter direction of the large diameter portion 73*a* with respect to the printer main body 11*a* by being fitted with the large diameter portion 73*a*. In the printer 11 having such a configuration, the waste ink tank 27 can be installed to the printer main body 11*a* in an easy manner.

As described in "Related Art", there is a case where a user using the printer 11 who installs the waste ink tank 27 tilts the posture of the waste ink tank 27 so as to insert the waste liquid discharging nozzle 73 into the insertion hole 57 and installs the waste ink tank 27 to the printer main body 11*a* with maintaining the posture of the waste ink tank 27. In such a case, for example, the posture of the waste ink tank 27 may be unintentionally changed during the installation operation by the user. When the posture of the waste ink tank 27 is changed, the waste liquid discharging nozzle 73 cannot be easily inserted into the insertion hole 57. As described above, generally, it is difficult to install the waste ink tank 27 to the printer main body 11*a* with the posture of the waste ink tank 27 maintained. In particular, when the waste ink tank 27 is to be installed to the printer main body 11*a* with the posture of the waste ink tank 27 tilted, the posture of the waste ink tank 27 may be easily changed during the installation operation, and it is difficult to have the waste ink tank 27 to reach a position for the insertion hole 57 to be fitted with the waste liquid discharging nozzle 73.

On the other hand, according to this embodiment, the insertion hole 57 determines the position of the waste ink tank 27 by being fitted with the large diameter portion 73*a* of the waste liquid discharging nozzle 73. In addition, the insertion hole 57 is brought into contact with the outer circumferential face of the small diameter portion 73*c*, which passes though the insertion hole 57 before the large diameter portion 73*a*, on the inner face of the insertion hole 57, whereby guiding the small diameter portion 73*c* to the position of the small diameter portion 73*c* for a case where the insertion hole 57 is fitted with the large diameter portion 73*a*. By using the guide function of the above-described insertion hole 57, even when the waste ink tank 27 is to be installed to the printer main body 11*a* with the posture of the waste ink tank 27 maintained, the waste ink tank 27 can be easily moved to a position in which the insertion hole 57 is fitted with the large diameter portion 73*a* in the installation direction. In other words, since the inner face of the insertion hole 57 and the outer circumferential face of the small diameter portion 73*c* are brought into contact with each other, the installation operation for the waste ink tank 27 can be performed in an easy manner.

In addition, when installed to the printer main body 11*a*, the waste ink tank 27 according to this embodiment is brought into contact with the outer circumferential face of the small diameter portion 73*c* that passes the inside of the insertion hole 57. Thereby, the waste ink tank 27 guides the small diameter portion 73*c* to a position of the small diameter portion 73*c* at a time when the insertion hole 57 is fitted with the large diameter portion 73*a*. As described above, the waste ink tank 27 guides the small diameter portion 73*c* to the above-described position, and whereby the waste ink tank 27 can easily reach a position, in which the insertion hole 57 is fitted with the large diameter portion 73*a*, in the installation direction. Accordingly, even when the waste ink tank 27 is to be installed to the printer main body 11*a* with the posture of the waste ink tank 27 maintained, it is possible to install the waste ink tank 27 to the printer main body 11*a* in an easy manner.

In addition, as in this embodiment, when the waste ink tank 27 is installed to the printer main body 11*a* inside the housing chamber 30 of the housing unit 26, the installation status (for example, the positional relationship between the waste liquid discharging nozzle 73*c* and the insertion hole 57) cannot be easily recognized visually. In such a case, generally, the installation operation cannot be performed easily. Even in such a case, the waste ink tank 27 guides the small diameter portion 73*c*, and whereby the waste ink tank 27 can reach a position, in which the insertion hole 57 is fitted with the large diameter portion 73*a*, in the installation direction in an easy manner. In other words, under the configuration of this embodiment, the waste ink tank 27 can be installed to the printer main body 11*a* inside the housing chamber 30 in an easy manner.

In addition, according to this embodiment, the installation direction for installing the waste ink tank 27 to the printer main body 11*a* is the horizontal direction, and the waste ink tank 27 is tilted such that the front end part of the waste ink tank 27 in the installation direction is located on the lower side relative to the rear end part thereof at a time when the waste ink tank 27 is installed to the printer main body 11*a*. Under such an installation operation, as described above, the posture of the waste ink tank 27 can be easily changed, and accordingly, it is difficult to install the waste ink tank 27 to the printer main body 11*a*. Even in such a case, the waste ink tank 27 guides the small diameter portion 73*c*, and whereby the installation operation of the waste ink tank 27 can be performed in an easy manner.

In addition, according to this embodiment, when the waste ink tank 27 is installed to the main body 11*a* of the printer, the waste ink tank 27 is configured to be brought into contact with the outer circumferential face of the small diameter portion 73*c* on the inner face of the insertion hole 57. In other words, according to this embodiment, the waste ink tank 27 is brought into contact with the outer circumferential face of the small diameter portion 73*c* by using a simple configuration. In other words, when a member for contacting the outer circumferential face of the small diameter portion 73*c* is not particularly disposed inside the container unit 44 of the waste ink tank 27, the waste ink tank 27 can guide the small diameter portion 73*c* by being brought into contact with the outer circumferential face of the small diameter portion 73*c*. In addition, as in this embodiment, when a member (for example, the ink absorber 88*b* located second from the lower side), other than the inner face of the insertion hole 57, to be brought into contact with the outer circumferential face of the small diameter portion 73*c* is disposed inside the container unit 44 of the waste ink tank 27, the waste ink tank 27 may be brought into contact with the outer circumferential face of the small diameter portion 73*c* in the above-described member instead of the inner face of the insertion hole 57 for guiding the small diameter portion 73*c*.

In addition, according to this embodiment, when the waste ink tank 27 is installed to the printer main body 11*a*, the waste ink tank 27 is configured to be brought into contact with the upper part of the outer circumferential face of the small diameter portion 73*c* in the upper part of the inner face of the insertion hole 57. In other words, the direction of the contact between the inner face of the insertion hole 57 and the outer circumferential face of the small diameter portion 73*c* follows the direction in which the force of gravity is acted. In such a case, without moving (lifting up) the waste ink tank 27 in a direction against the force of gravity, the inner face of the insertion hole 57 and the outer circumferential face of the small diameter portion 73*c* are brought into contact with each other. As a result, the installation operation of the waste ink tank 27 can be performed in an easier manner.

In addition, according to this embodiment, the coil spring 80 that is included in the printer main body 11*a* biases the small diameter portion 73*c* such that the outer circumferential face of the small diameter portion 73*c* faces the inner face of the insertion hole 57 during a period in which the small diameter portion 73*c* of the waste liquid discharging nozzle 73 passes the inside of the insertion hole 57. In addition, the waste ink tank 27 is configured to be brought into contact with the outer circumferential face of the small diameter portion 73*c* that is biased by the coil spring 80 as described above on the inner face of the insertion hole 57. In other words, since the biasing force of the coil spring 80 acts as an auxiliary force at a time when the waste ink tank 27 is brought into contact with the outer circumferential face of the small diameter portion 73*c* on the inner face of the insertion hole 57, the waste ink tank 27 can be brought into contact with the outer circumferential face of the small diameter portion 73*c* assuredly. In other words, the waste ink tank 27 can guide the small diameter portion 73*c* assuredly. As a result, the installation operation of the waste ink tank 27 can be performed in a much easier manner.

In addition, according to this embodiment, the waste ink tank 27 is continuously brought into contact with the outer circumferential face of the small diameter portion 73*c* during a period in which the small diameter portion 73*c* passes the inside of the insertion hole 57, and thereby the small diameter portion 73*c* is guided continuously. In other words, while passing through the inside of the insertion hole 57, the small diameter portion 73*c* is guided by the waste ink tank 27 all the time. Accordingly, the movement of the waste ink tank 27 for positioning the small diameter portion 73*c* to a position in which the small diameter portion 73*c* is located at a time when the insertion hole 57 is fitted with the large diameter portion 73*a* can be performed more easily. As a result, the installation operation of the waste ink tank 27 can be performed in an easier manner.

Other Embodiments

As above, the waste ink tank 27 as a liquid housing body and the printer 11 as a waste liquid discharging device have been mainly described based on the above-described embodiment. However, the above-described embodiment is not for limiting the scope of the invention but for the purpose of easy understanding of the invention. It is apparent that the invention may be changed or modified without departing from the gist of the invention, and equivalents thereof belong to the scope of the invention.

Figure 11:
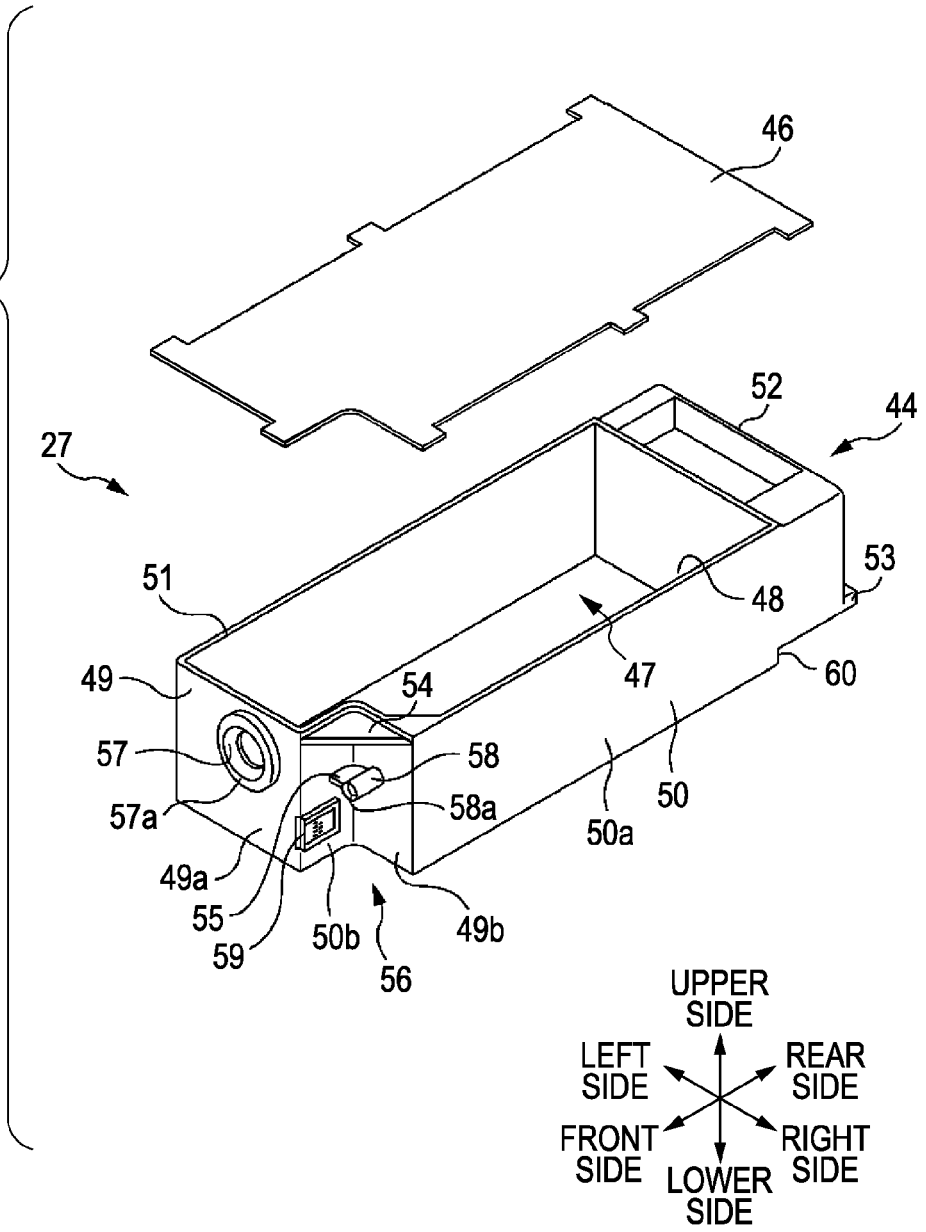
FIG. 11 is an exploded perspective view of a waste ink tank 27 according to another embodiment of the invention.

In the above-described embodiment, a case (hereinafter, referred to as this embodiment) where the waste ink tank 27 includes the ink absorbers 88*a*, 88*b*, 88*c*, and 88*d* has been described. However, the invention is not limited to the above-described embodiment, and a case (hereinafter, referred to as another embodiment) where the waste ink tank 27 does not include the ink absorbers 88*a*, 88*b*, 88*c*, and 88*d* may be also considered. Hereinafter, the configuration of a waste ink tank 27 according to another embodiment and the sequence for installing the ink tank 27 according to another embodiment to the printer main body 11*a* will be described with reference to FIG. 11 and FIGS. 12A to 12E. FIG. 11 is an exploded perspective view of the waste ink tank 27 according to another embodiment and corresponds to FIG. 4. FIGS. 12A to 12E are explanatory diagrams for the sequence of installing the waste ink tank 27 according to another embodiment to the printer main body 11*a*.

The waste ink tank 27 according to another embodiment, as shown in FIG. 11, has a same structure as that of the waste ink tank 27 according to this embodiment except that the ink absorbers 88*a*, 88*b*, 88*c*, and 88*d* and members (that is, the cylinder part 93 and the support rib 94) used for determining the positions of the ink absorbers 88*a*, 88*b*, 88*c*, and 88*d* inside the container unit 44 are not included. In another embodiment, the waste ink tank 27 is installed to the printer main body 11*a* in accordance with the same sequence as that of this embodiment.

Figure 12A:
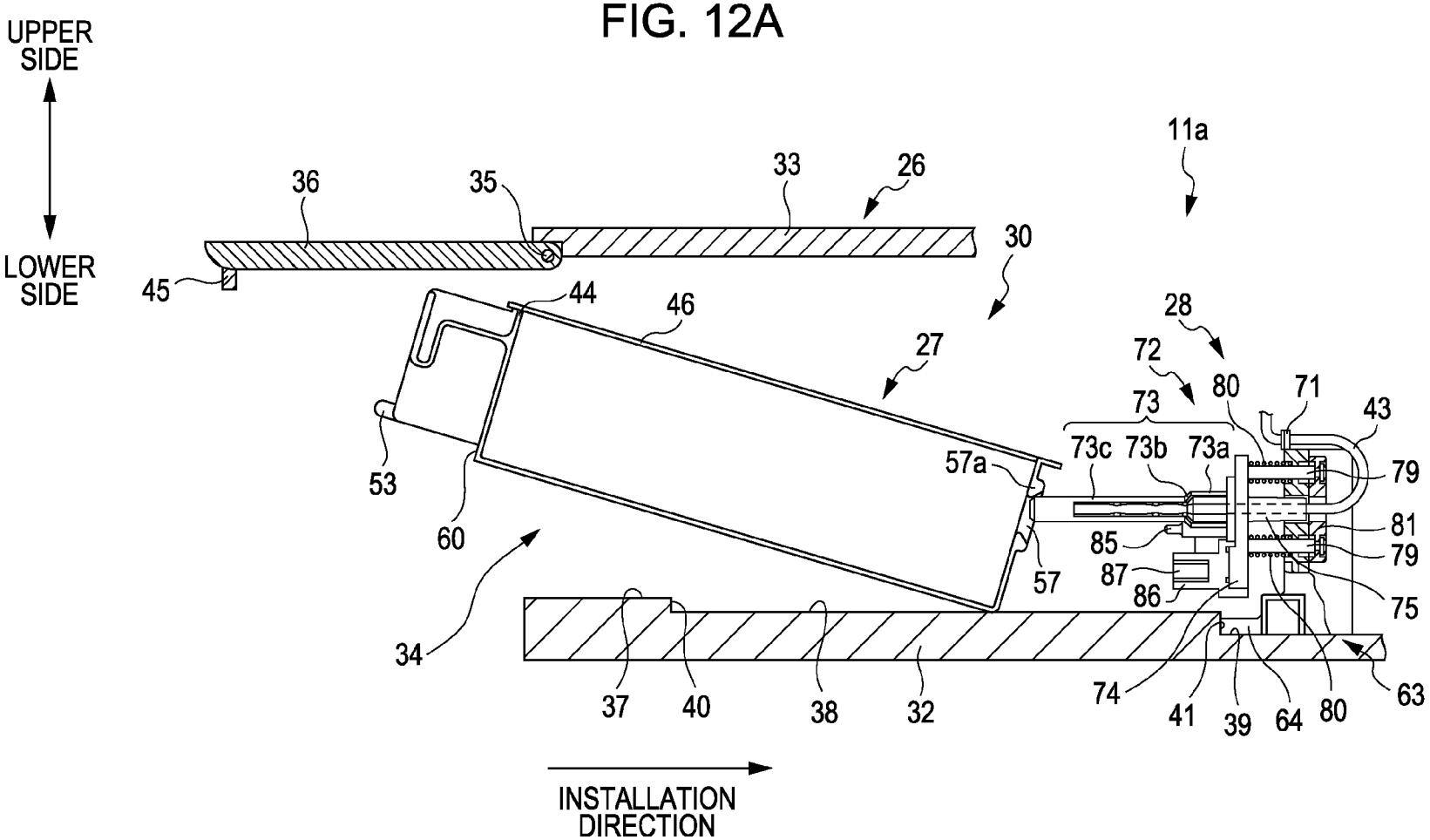
FIG. 12A is a first explanatory diagram for the sequence of installing the waste ink tank 27 to a printer main body 11*a* according to another embodiment of the invention.

In other words, the waste ink tank 27 according to another embodiment, as shown in FIG. 12A, is installed to the printer main body 11*a* in a tilted state in which the front end part of the waste ink tank 27 is located on the lower side relative to the rear end part thereof. While the small diameter portion 73*c* passes the insertion hole 57 after the upper part of the front end of the waste liquid discharging nozzle 73 is brought into contact with the upper part of the inner face of the insertion hole 57, the waste ink tank 27 is continuously brought into contact with the upper part of the outer circumferential face of the small diameter portion 73*c* in the upper part of the inner face of the insertion hole 57. Accordingly, also in another embodiment, the waste ink tank 27 continuously guides the small diameter portion 73*c* to the position in which the small diameter portion 73*c* is located at a time when the insertion hole 57 is fitted with the large diameter portion 73*a* of the waste liquid discharging nozzle 73 while the small diameter portion 73*c* passes the insertion hole 57.

Figure 12B:
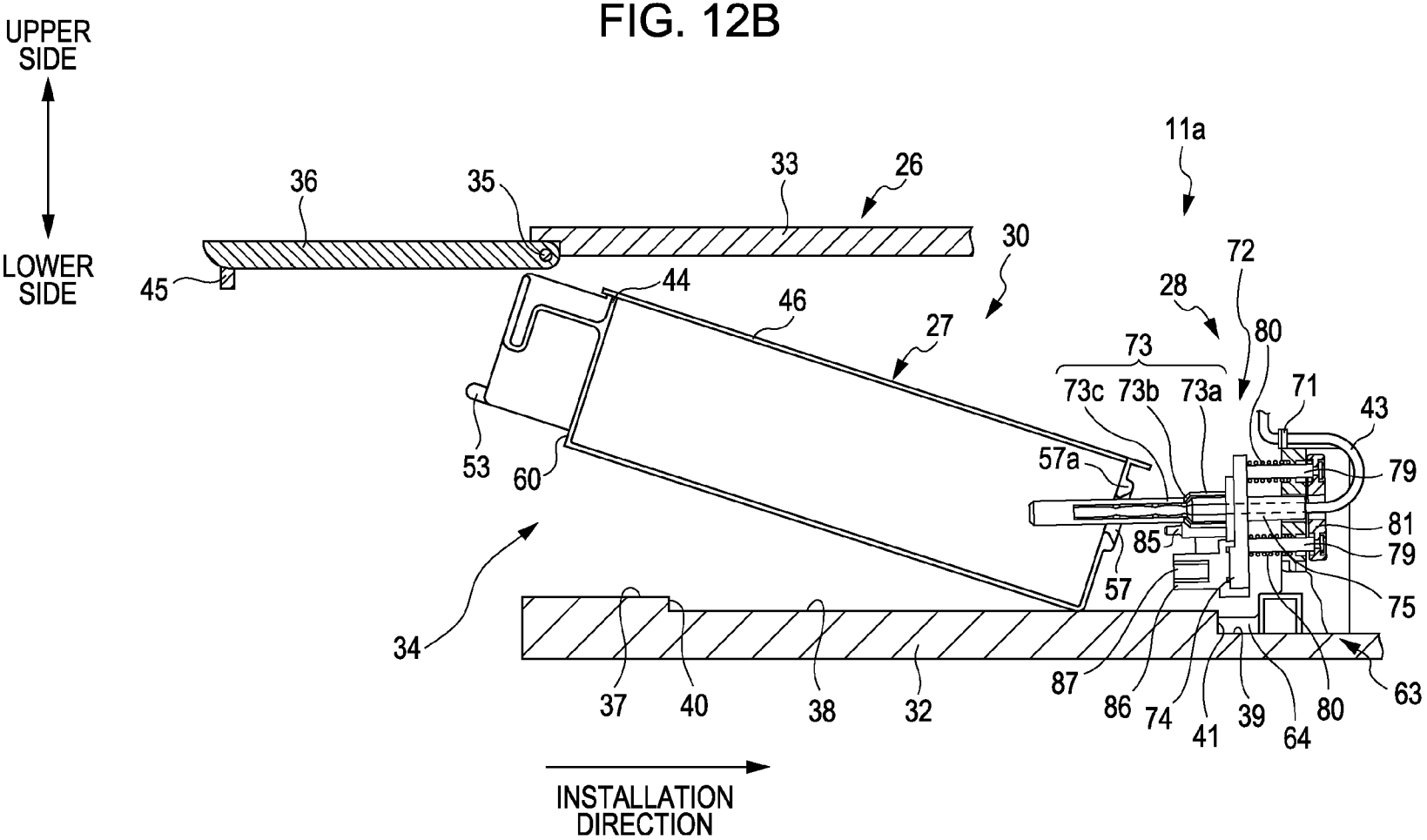
FIG. 12B is a second explanatory diagram for the sequence of installing the waste ink tank 27 to the printer main body 11*a* according to another embodiment of the invention.
Figure 12C:
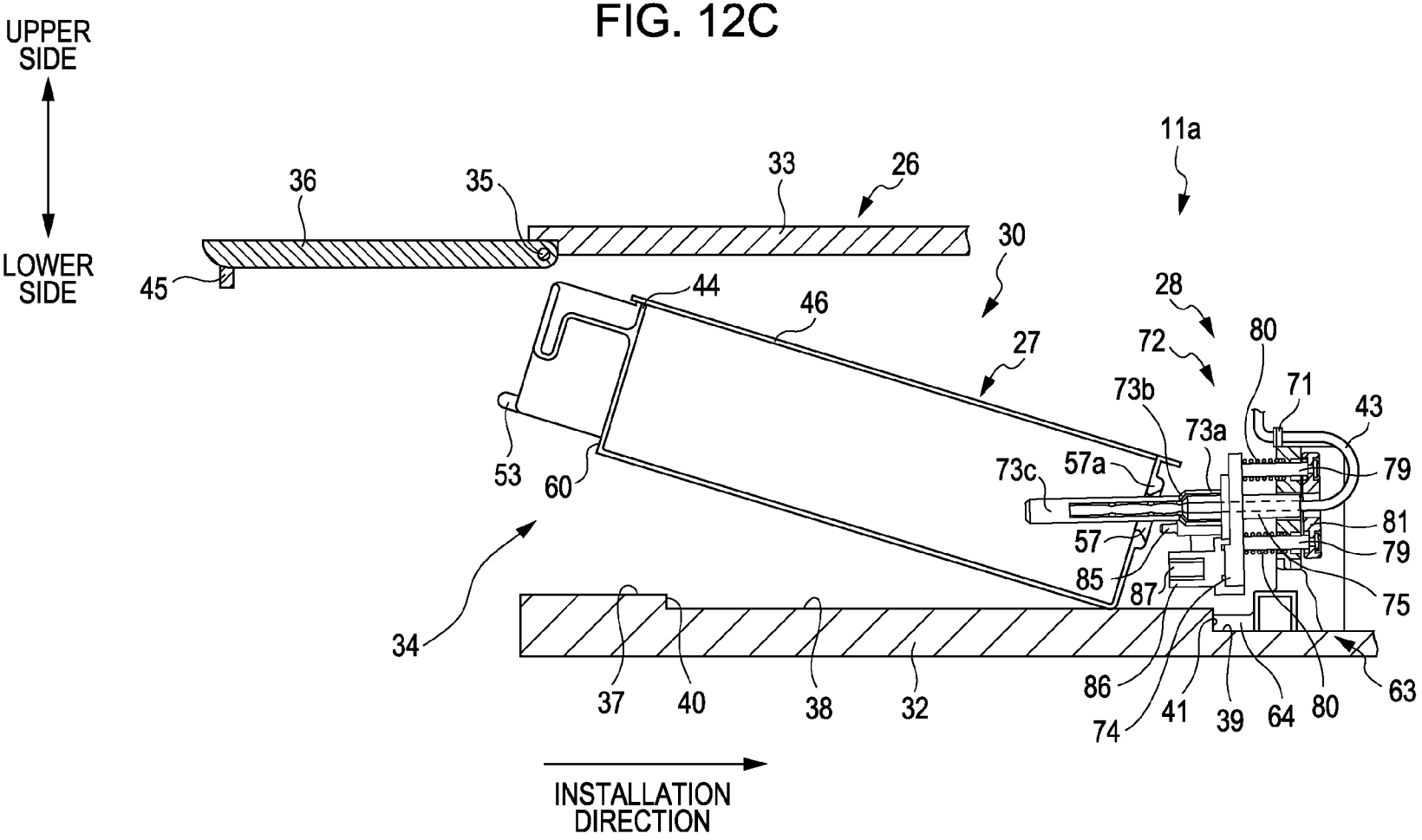
FIG. 12C is a third explanatory diagram for the sequence of installing the waste ink tank 27 to the printer main body 11*a* according to another embodiment of the invention.

Described in more details, the waste ink tank 27 according to another embodiment, as in this embodiment, presses the small diameter portion 73*c* to the lower side in resistance against the biasing force of the coil spring 80 in the upper part of the inner face of the insertion hole 57 while the small diameter portion 73*c* of the waste liquid discharging nozzle 73 passes the insertion hole 57. In other words, the waste ink tank 27 according to another embodiment is continuously brought into contact with the small diameter portion 73*c*, which is biased by the coil spring 80 so as to face the upper part of the outer circumferential face of the small diameter portion 73*c* toward the upper part of the inner face of the insertion hole 57 in the upper part of the inner face of the insertion hole 57 while the small diameter portion 73*c* passes the insertion hole 57. Accordingly, while the small diameter portion 73*c* passes the insertion hole 57, as shown in FIGS. 12B and 12C, the waste ink tank 27 is pushed in the installation direction, so that the upper part of the inner face of the insertion hole 57 slides on the upper part of the outer circumferential face of the same diameter portion of the small diameter portion 73*c*.

Figure 12D:
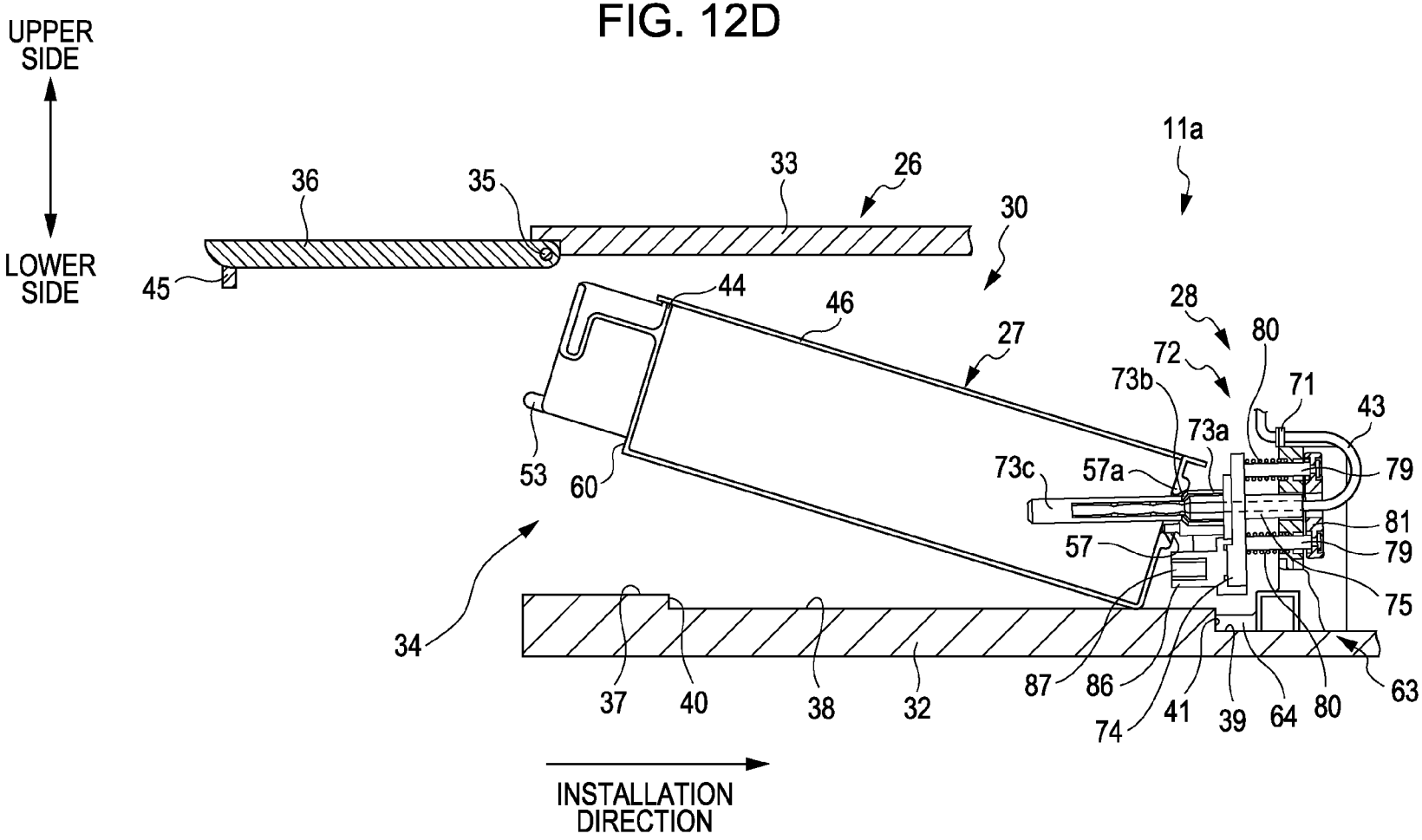
FIG. 12D is a fourth explanatory diagram for the sequence of installing the waste ink tank 27 to the printer main body 11*a* according to another embodiment of the invention.
Figure 12E:
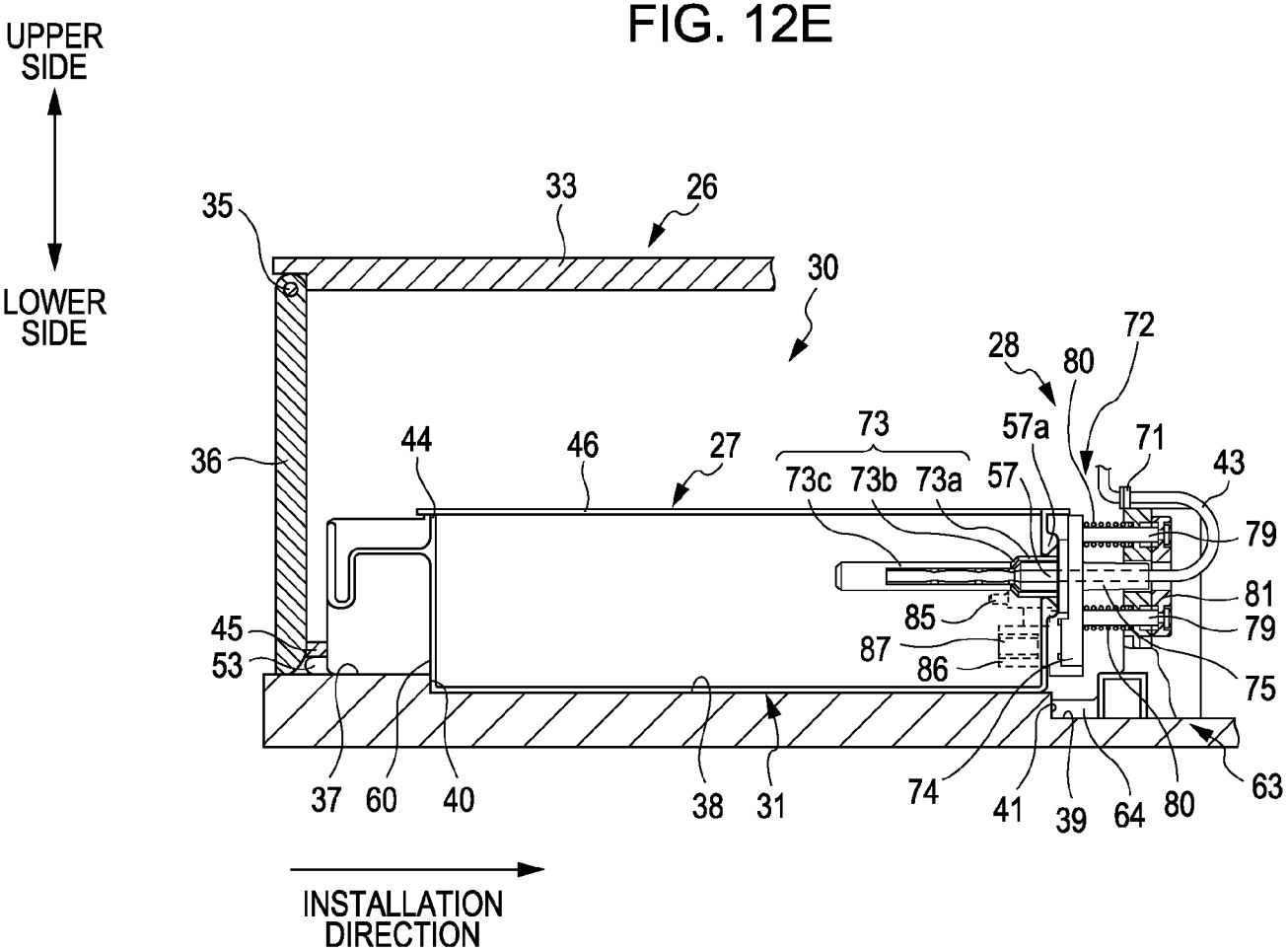
FIG. 12E is a fifth explanatory diagram for the sequence of installing the waste ink tank 27 to the printer main body 11*a* according to another embodiment of the invention.

Then, when the waste ink tank 27 is pushed further to the back side with the contact state between the upper part of the inner face of the insertion hole 57 and the upper part of the outer circumferential face of the small diameter portion 73*c* maintained, finally, as shown in FIG. 12D, the waste ink tank 27 reaches a position in which the upper part of the inner face of the insertion hole 57 is brought into contact with the upper part of the outer circumferential face of the taper part 73*b*. Then, when the waste ink tank 27 is pushed further to the inner side from the above-described position, the upper part of the inner face of the insertion hole 57 slides on the upper part of the outer circumferential face of the taper part 73*b* and then is brought into contact with the upper part of the outer circumferential face of the large diameter portion 73*a*. Thereafter, as in this embodiment, when the waste ink tank 27 is pushed further to the backside with the waste ink tank 27 returned to the horizontal posture, the insertion hole 57 is fitted with the large diameter portion 73*a*. Accordingly, the position of the waste ink tank 27 in the diameter direction of the large diameter portion 73*a* with respect to the printer main body 11*a* is determined. Then, finally, the waste ink tank 27, as shown in FIG. 12E, is determined to be positioned in the installation position 31 and is set in the installation position 31.

As described above, also in another embodiment, when the waste ink tank 27 is installed to the printer main body 11*a*, the waste ink tank 27 guides the small diameter portion 73*c* by being brought into contact with the outer circumferential face of the small diameter portion 73*c* on the inner face of the insertion hole 57. Under such a configuration, even when the waste ink tank 27 does not have the ink absorbers 88*a*, 88*b*, 88*c*, and 88*d*, the waste ink tank 27 can be installed to the printer main body 11*a* in an easy manner.

In addition, in the above-described embodiment, as an example of the waste liquid discharging device, a fluid injecting apparatus (that is, the printer 11) that injects ink as the waste liquid has been described as an example. Here, the ink may be water-based ink or oil-based ink.

In addition, as fluid injected as the waste liquid is not limited to ink. As a different waste liquid discharging device, a fluid injecting apparatus that injects a liquid (including a liquid body in which particles of a function material is dispersed and a fluid body such as gel along with the liquid) other than ink or a fluid body (including solid that can be injected as a fluid body) other than the liquid as a waste liquid may be considered. The invention may be applied to such an apparatus.

For example, the invention may be applied to a liquid injecting apparatus that injects a liquid-form body in which a material such as an electrode material or a coloring material that is used for manufacturing a liquid crystal display, an EL (electroluminescence) display, a field emission display (FED), or the like is contained in a dispersed state or a dissolved state, a liquid injecting apparatus that injects a bioorganic material that is used for manufacturing a bio chip, or a liquid injecting apparatus that injects liquid that becomes a test material for a precision pipette. Furthermore, the invention may be applied to a liquid injecting apparatus that injects a lubricant to a precision machine such as a clock or a camera in a pin-point manner, a liquid injecting apparatus that injects a transparent resin solution such as an ultraviolet-curable resin onto a substrate for forming a tiny hemispherical lens (optical lens) or the like that is used in an optical communication element or the like, a liquid injecting apparatus that injects an acid or alkali etching liquid for etching a substrate or the like, or a fluid-form body injecting apparatus that injects gel, or a powder injecting-type recording apparatus that injects solid such as a powder including toner or the like. The invention may be applied to any one type of the above-described fluid injecting apparatuses.

What is claimed is:

1. A waste liquid container that is detachably installed to a waste liquid discharging device main body, the waste liquid container comprising:

an insertion hole into which a large diameter portion of a waste liquid discharging nozzle can be inserted, the waste liquid discharging nozzle being included in the waste liquid discharging device main body, the waste liquid discharging nozzle having the large diameter portion, a small diameter portion located on a front end side relative to the large diameter portion, and a taper portion located between the large diameter portion and the small diameter portion, the taper portion having a diameter that is less than the large diameter portion and greater than the small diameter portion, wherein when the waste liquid container is installed to the waste liquid discharging device main body, the insertion hole receives the taper portion after receiving a discharging opening of the waste liquid discharging nozzle and determines a position of the waste liquid container in a diameter direction of the large diameter portion with respect to the waste liquid discharging device main body by being fitted with the large diameter portion, wherein an ink absorber is held in the waste liquid container, the ink absorber having a groove, wherein the groove has a width narrower than an inner-side opening of the insertion hole to guide the small diameter portion of the waste liquid discharging nozzle.

2. The waste liquid container according to claim 1, wherein an installation direction for installing the waste liquid container to the waste liquid discharging device main body is a horizontal direction, and the waste liquid container is tilted such that a front end part of the waste liquid container in the installation direction is located on a lower side relative to a rear end part of the waste liquid container when the waste liquid container is installed to the waste liquid discharging device main body, and wherein the insertion hole guides the small diameter portion to a position in which the small diameter portion is located at a time when the insertion hole is fitted with the large diameter portion by bringing an inner-side opening of the insertion hole into contact with the outer circumferential face of the small diameter portion.

3. The waste liquid container according to claim 2, wherein the insertion hole is brought into contact with an upper part of the outer circumferential face of the small diameter portion in an upper part of the inner face of the insertion hole when the waste liquid container is installed to the waste liquid discharging device main body.

4. The waste liquid container according to claim 2, wherein the insertion hole is brought into contact with the outer circumferential face of the small diameter portion that is biased in the inner-side opening of the insertion hole by a biasing member, which is included in the waste liquid discharging device main body, so as to face the outer circumferential face of the small diameter portion toward the inner-side opening of the insertion hole when the waste liquid container is installed to the waste liquid discharging device main body.

5. The waste liquid container according to claim 1, wherein the insertion hole continuously guides the small diameter portion by being continuously brought into contact with an outer circumferential face of the small diameter portion in an upper part of the inner-side opening of the insertion hole while the small diameter portion passes an inside of the insertion hole.

6. The waste liquid container according to claim 1, wherein an ink absorber is held in the waste liquid container, the ink absorber having a groove, wherein while the waste liquid container is being removed from the waste liquid discharging device main body, the front end of the small diameter portion temporarily makes contact with a bottom of the groove of the ink absorber.

7. The waste liquid container according to claim 1, wherein the insertion hole has an aperture that gradually decreases from an opening edge of the insertion hole toward an inner part of the insertion hole.

8. The waste liquid container according to claim 7, wherein an ink absorber is held in the waste liquid container, the ink absorber having a groove, wherein an inner-side opening of the insertion hole is wider than an opening of the groove.

9. The waste liquid container according to claim 1, wherein an ink absorber is held in the waste liquid container, the ink absorber having a groove, wherein when the waste liquid container is installed in the liquid discharging device main body, the large diameter portion is surrounded by the groove of the ink absorber.

10. The waste liquid container according to claim 1, wherein when the waste liquid container is installed in the waste liquid discharging device main body, the waste liquid discharging device main body creates a chamber for holding the waste liquid container such that the waste liquid discharging device main body surrounds the waste liquid container.

11. The waste liquid container according to claim 1, wherein the insertion hole is formed in one of a plurality of walls forming an opening and spaced apart from a positioning part extending from a bottom face at a location spaced apart from the plurality of walls.

12. The waste liquid container according to claim 1, wherein an ink absorber is held in the waste liquid container, wherein while the waste liquid container is being installed to the waste liquid discharging device main body, an upper surface of the ink absorber temporarily comes in contact with the front end of the small diameter portion, and wherein when the waste liquid container is installed to the waste liquid discharging device main body, the ink absorber is spaced apart from the front end of the small diameter portion and the upper surface is located at a position lower than the front end of the small diameter portion.

13. The waste liquid container according to claim 1, wherein the insertion hole is formed in a front wall with a depressed part formed at a corner junction of a front wall and a side wall in a direction transverse to the direction of insertion of the waste liquid discharging nozzle into the insertion hole.

14. A waste liquid container that is detachably installed to a waste liquid discharging device main body, the waste liquid container comprising:

an insertion hole into which a large diameter portion of a waste liquid discharging nozzle can be inserted, the waste liquid discharging nozzle being included in the waste liquid discharging device main body, the waste liquid discharging nozzle having the large diameter portion, a small diameter portion located on a front end side relative to the large diameter portion, and a taper portion located between the large diameter portion and the small diameter portion, the taper portion having a diameter that is less than the large diameter portion and greater than the small diameter portion, wherein when the waste liquid container is installed to the waste liquid discharging device main body, the insertion hole receives the taper portion after receiving a discharging opening of the waste liquid discharging nozzle and determines a position of the waste liquid container in a diameter direction of the large diameter portion with respect to the waste liquid discharging device main body by being fitted with the large diameter portion, wherein a position adjusting hole is formed in a front wall of the waste liquid container, the position adjusting hole being formed so as to suppress rotation of the waste liquid container after the insertion hole receives the large diameter portion of the waste liquid discharging nozzle, wherein a stair part is located at a rear end of a bottom surface in a detached direction for detaching the waste liquid container from the waste liquid discharging device main body, the stair part being formed so as to determine a position of the waste liquid container in the detached direction after the position adjusting hole suppressed rotation of the waste liquid container.

15. The waste liquid container according to claim 14, wherein a lead-out part is formed at a rear wall located in a detached direction for detaching the waste liquid container from the waste liquid discharging device main body, the lead-out part protruding from the rear wall so as to suppress an upward movement of the rear wall side of the waste liquid container after the stair part determined the position of the waste liquid container in the detached direction.

* * * * *